US008998633B2

(12) United States Patent
Lopez

(10) Patent No.: US 8,998,633 B2
(45) Date of Patent: Apr. 7, 2015

(54) ELECTRICAL CONNECTOR APPARATUS, LIGHTING DEVICE POSITIONING APPARATUS AND METHOD OF ELECTRICALLY CONNECTING APPARATUS

(75) Inventor: Peter E. Lopez, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/461,248

(22) Filed: May 1, 2012

(65) Prior Publication Data

US 2013/0176745 A1 Jul. 11, 2013

Related U.S. Application Data

(60) Provisional application No. 61/584,524, filed on Jan. 9, 2012.

(51) Int. Cl.

| | |
|---|---|
| ***H01R 13/64*** | (2006.01) |
| ***F21S 8/02*** | (2006.01) |
| ***F21V 23/06*** | (2006.01) |
| *F21Y 101/02* | (2006.01) |
| *H01R 13/627* | (2006.01) |

(52) U.S. Cl.

CPC ..... *F21V 23/06* (2013.01); *F21S 8/026* (2013.01); *F21Y 2101/02* (2013.01); *H01R 13/6275* (2013.01); *H01R 13/64* (2013.01); *Y10T 29/49117* (2013.01)

(58) Field of Classification Search

USPC ..... 439/607.41–607.52, 374, 350–353, 439/355–358, 366, 367, 680, 682, 686, 695, 439/696

See application file for complete search history.

(56) References Cited

U.S. PATENT DOCUMENTS

| | | | | |
|---|---|---|---|---|
| 4,449,778 | A * | 5/1984 | Lane | 439/607.47 |
| 4,611,878 | A * | 9/1986 | Hall et al. | 439/607.47 |
| 4,767,362 | A * | 8/1988 | Moji | 439/607.41 |
| 4,929,195 | A * | 5/1990 | Seidoh | 439/607.45 |
| 5,052,949 | A * | 10/1991 | Lopata et al. | 439/607.45 |
| 5,059,140 | A * | 10/1991 | Philippson et al. | 439/607.02 |
| 5,232,380 | A * | 8/1993 | Inoue et al. | 439/607.5 |
| 5,819,405 | A * | 10/1998 | Marder et al. | 29/857 |
| 5,961,351 | A * | 10/1999 | Wu | 439/607.45 |
| 6,508,671 | B2 * | 1/2003 | Ko | 439/607.48 |

(Continued)

OTHER PUBLICATIONS

U.S. Appl. No. 13/621,475, filed Sep. 17, 2012, Lopez et al.

*Primary Examiner* — Ross Gushi
(74) *Attorney, Agent, or Firm* — Burr & Brown, PLLC

(57) ABSTRACT

A lighting device, comprising a power input assembly engagement structure that comprises a keying region, an electrical connector region and a power input assembly engagement region. A power input assembly, comprising a second electrical connector region held by, a positioning element and a holding structure, the positioning element releasably engaged with the holding structure. A lamp comprising a power input assembly and a lighting device comprising an engagement structure. A method comprising engaging a second electrical connector region of a power input assembly with a first electrical connector region of a lighting device. A lighting device positioning apparatus, comprising a lighting device mounting region, a first slide member comprising a retaining structure-receiving feature and a first slot, a second slide member comprising a second slot extending in a direction differing 20 degrees from the first slot, and a connector extending through the first and second slots.

30 Claims, 19 Drawing Sheets

(56) References Cited

U.S. PATENT DOCUMENTS

| | | | | |
|---|---|---|---|---|
| 6,997,749 | B1 * | 2/2006 | Harubayashi | 439/607.45 |
| 7,066,744 | B2 * | 6/2006 | Kameyama et al. | 439/108 |
| 7,226,316 | B2 * | 6/2007 | Wu | 439/607.44 |
| 7,361,054 | B2 * | 4/2008 | Kuo | 439/607.41 |
| 7,628,638 | B2 * | 12/2009 | Wu | 439/358 |
| 7,677,936 | B2 * | 3/2010 | Sato et al. | 439/892 |
| 7,811,115 | B1 * | 10/2010 | Tyler | 439/352 |
| 8,152,562 | B2 * | 4/2012 | Gross | 439/533 |
| 8,235,744 | B1 * | 8/2012 | Liptak et al. | 439/352 |
| 8,262,421 | B2 * | 9/2012 | De Blieck et al. | 439/741 |
| 2001/0021602 | A1 * | 9/2001 | Zanten | 439/358 |
| 2004/0033714 | A1 * | 2/2004 | Maini et al. | 439/357 |
| 2010/0041266 | A1 * | 2/2010 | Data et al. | 439/358 |
| 2010/0093218 | A1 * | 4/2010 | Zhang et al. | 439/607.45 |
| 2010/0255709 | A1 * | 10/2010 | Tyler | 439/367 |

* cited by examiner

ELECTRICAL CONNECTOR APPARATUS, LIGHTING DEVICE POSITIONING APPARATUS AND METHOD OF ELECTRICALLY CONNECTING APPARATUS

CROSS-REFERENCE TO RELATED APPLICATIONS

This application claims the benefit of U.S. Provisional Patent Application No. 61/584,524, filed Jan. 9, 2012, the entirety of which is incorporated herein by reference as if set forth in its entirety.

FIELD OF THE INVENTIVE SUBJECT MATTER

The present inventive subject matter relates to apparatus that provides (or assists in providing) electrical connection between two or more components. In some aspects, the present inventive subject matter relates to apparatus that provides (or assists in providing) electrical connection between a power input assembly (e.g., which may comprise one or more conductors of electricity) and a lighting device (e.g., which may comprise one or more light emitters that are illuminated by having electricity supplied to them). In some aspects, the present inventive subject matter relates to apparatus that provides (or assists in providing) mechanical connection between two or more components that are being electrically connected. The present inventive subject matter also relates to methods of providing electrical connection between two or more components, e.g., between a power input assembly and a lighting device. The present inventive subject matter also relates to lighting device positioning apparatuses

BACKGROUND

There is an ongoing need for electrical connector apparatus (and methods of electrically connecting apparatus), that provide reliable electrical connection. There is also an ongoing need for electrical connector apparatus (and methods of electrically connecting apparatus), that provide reliable electrical connection as well as reliable mechanical connection. There is also an ongoing need for these types of electrical connector apparatus (and methods of electrically connecting apparatus), that are simple to electrically connect. There is also an ongoing need for these types of electrical connector apparatus (and methods of electrically connecting apparatus), that can be connected in small spaces. There is also an ongoing need for these types of electrical connector apparatus (and methods of electrically connecting apparatus), that can be employed in the context of retrofitting replacement apparatus into existing apparatus (e.g., replacing apparatus that comprises one or more light emitters with new apparatus that comprises one or more new light emitters, e.g., one or more solid state light emitters such as light emitting diodes).

BRIEF SUMMARY

The present inventive subject matter provides lighting devices and power input assemblies, and components for such lighting devices and power input assemblies, such power input assemblies configured so that a first electrical connection region in or on such a lighting device can be electrically connected to a second electrical connection region in or on such a power input assembly.

In some aspects of the present inventive subject matter, such electrical connection can be accomplished in a single step using one hand. In some of such aspects, the single step can consist of moving a lighting device in a single direction relative to a power input assembly to accomplish such electrical connection and optionally also mechanical connection between the lighting device and the power input assembly.

In some aspects of the present inventive subject matter, there is provided a lighting device that comprises at least a first light emitter and an engagement structure. In some of such aspects, the engagement structure comprises at least one of a keying region, an electrical connector region and a power input assembly engagement region.

In some aspects of the present inventive subject matter, there is provided a power input assembly that comprises at least a first electrical connector region and at least a first positioning element.

In some aspects of the present inventive subject matter, there is provided a power input assembly that comprises at least a first electrical connector region and at least a first holding structure.

In some aspects of the present inventive subject matter, there is provided a power input assembly that comprises at least a first positioning element and at least a first holding structure.

In accordance with a first aspect of the present inventive subject matter, there is provided a lighting device, comprising:

a power input assembly engagement structure that comprises:

at least a first keying region;

at least a first electrical connector region; and at least a first power input assembly engagement region.

In some embodiments in accordance with the first aspect of the present inventive subject matter, which can include or not include, as suitable, any of the other features described herein, the lighting device further comprises at least a first light emitter.

In some embodiments in accordance with the first aspect of the present inventive subject matter, which can include or not include, as suitable, any of the other features described herein, the first power input assembly engagement region comprises at least a first spring element.

In some embodiments in accordance with the first aspect of the present inventive subject matter, which can include or not include, as suitable, any of the other features described herein, the first power input assembly engagement region comprises at least a first spring element-receiving region. In some of such embodiments, the first spring element-receiving region comprises at least one recess, and/or the first spring element-receiving region comprises at least one opening.

In some embodiments in accordance with the first aspect of the present inventive subject matter, which can include or not include, as suitable, any of the other features described herein:

the lighting device further comprises at least a second power input assembly engagement region; and the first and second power input assembly engagement regions are on opposite sides relative to the first electrical connector region.

In some embodiments in accordance with the first aspect of the present inventive subject matter, which can include or not include, as suitable, any of the other features described herein, the first keying region comprises at least a first protrusion. In some of such embodiments, the first post extends in a direction substantially parallel to an axis of the lighting device.

In accordance with a second aspect of the present inventive subject matter, there is provided a power input assembly, comprising:

at least a second electrical connector region;

at least a first positioning element; and at least a first holding structure, the first positioning element releasably engaged with the first holding structure, the second electrical connector region held by the first positioning element, whereby the second electrical connector region is held in place relative to the first holding structure.

In some embodiments in accordance with the second aspect of the present inventive subject matter, which can include or not include, as suitable, any of the other features described herein, the power input assembly further comprises at least a first electrical conductor. In some of such embodiments:

the power input assembly further comprises at least a first conduit, and the electrical conductor extends through at least a portion of the first conduit.

In some embodiments in accordance with the second aspect of the present inventive subject matter, which can include or not include, as suitable, any of the other features described herein, the power input assembly further comprises at least a first conduit.

In some embodiments in accordance with the second aspect of the present inventive subject matter, which can include or not include, as suitable, any of the other features described herein, the second electrical connector region comprises at least a first alignment structure. In some of such embodiments, the first alignment structure comprises at least a first protrusion, a first recess or a first hole.

In some embodiments in accordance with the second aspect of the present inventive subject matter, which can include or not include, as suitable, any of the other features described herein, the first positioning element comprises:

at least a first body structure; and at least a first alignment feature. In some of such embodiments, the second electrical connector region comprises at least a second alignment structure that engages with the first alignment feature.

In some embodiments in accordance with the second aspect of the present inventive subject matter, which can include or not include, as suitable, any of the other features described herein, the first positioning element comprises at least a first body structure that comprises at least a first body element and a second body element. In some of such embodiments:

the first body element comprises at least a first pin, the second body element comprises at least a first pin-receiving region, the first pin extends through a space defined by the first pin-receiving region, and at least a portion of the second electrical connector region is between (1) at least a portion of the first body element and (2) at least a portion of the second body element.

In some embodiments in accordance with the second aspect of the present inventive subject matter, which can include or not include, as suitable, any of the other features described herein:

the first positioning element comprises at least a first body structure and at least a first retention element, the first retention element comprises at least a first flange, the first body structure has at least one flange engagement structure, the first flange has at least one body structure engagement structure, the flange engagement structure is engaged with the body structure engagement structure, whereby the first retention element is inhibited from rotating relative to the first body structure.

In some embodiments in accordance with the second aspect of the present inventive subject matter, which can include or not include, as suitable, any of the other features described herein, the first positioning element comprises at least a first retention element that comprises at least a first flex element. In some of such embodiments:

the first holding structure comprises at least a first flex element engagement structure, and the first flex element is releasably engaged with the first flex element engagement structure, whereby the first positioning element releasably engaged with the first holding structure, and/or in some of such embodiments, the first flex element and the first flex element engagement structure are configured so that during assembly, the first positioning element is pushed in a first direction relative to the first holding structure, and said pushing the first positioning element in the first direction sequentially (1) causes the first flex element to come into contact with the first flex element engagement structure, which (2) causes the first flex element to flex in an inward direction, and then the first flex element clears the first flex element engagement structure, which (3) allows the first flex element to flex in an outward direction, thereby inhibiting motion of the first positioning element relative to the first holding structure in a second direction, the second direction opposite the first direction.

In some embodiments in accordance with the second aspect of the present inventive subject matter, which can include or not include, as suitable, any of the other features described herein:

the power input assembly further comprises at least a first conduit;

the first positioning element comprises at least a first retention element that comprises at least a first conduit engagement structure, and the first conduit and the first conduit engagement structure are configured such that during assembly, the first conduit is rotated relative to its axis and the first conduit engagement structure is threaded along an external surface of the first conduit.

In some embodiments in accordance with the second aspect of the present inventive subject matter, which can include or not include, as suitable, any of the other features described herein, the first positioning element comprises at least a first retention element that comprises at least a first flange. In some of such embodiments:

the first flange has at least a first indexing feature, the first holding structure has at least a second indexing feature, the first indexing feature is engaged with the second indexing feature to inhibit rotation of the first retention element relative to the first holding structure, and/or in some of such embodiments:

the first body structure has at least a first indexing feature, the first holding structure has at least a second indexing feature, the first indexing feature is engaged with the second indexing feature to inhibit rotation of the first body structure relative to the first holding structure, and/or in some of such embodiments:

the first body structure comprises at least a first flexible structure and a second flexible structure, the first indexing feature is a gap is between a free end of the first flexible structure and a free end of the second flexible structure, and/or in some of such embodiments:

the first body structure further comprises at least a third indexing structure, the third indexing structure is engaged with the second indexing feature, and the third indexing structure is spaced from the gap by a distance that is at least 25 percent of a distance of the largest dimension of the first body structure.

In some embodiments in accordance with the second aspect of the present inventive subject matter, which can include or not include, as suitable, any of the other features described herein:

the first positioning element comprises at least a first body structure and a first retention element, the first body structure comprises at least a first flexible structure and a second flexible structure, the first retention element comprises at least a first flange, a first portion of the first body structure is on a first side of the first flange, the first flexible structure and the second flexible structure are on a second side of the first flange. In some of such embodiments, the first positioning element comprises at least a first retention element that comprises at least a first flex element, and/or in some of such embodiments:

the first holding structure comprises at least a first flex element engagement structure, and the first flex element engagement structure is engaged with the first flex element.

In some embodiments in accordance with the second aspect of the present inventive subject matter, which can include or not include, as suitable, any of the other features described herein, the first holding structure comprises at least a first lighting device engagement region. In some of such embodiments, the first lighting device engagement region comprises at least a first spring element, and/or in some of such embodiments, the first power input assembly engagement region comprises at least a first spring element-receiving region, and/or in some of such embodiments, the first spring element-receiving region comprises at least one recess, and/or in some of such embodiments, the first spring element-receiving region comprises at least one opening, and/or in some of such embodiments:

the first holding structure further comprises at least a second lighting device engagement region; and the first and second lighting device engagement regions are on opposite sides relative to the second electrical connector region.

In some embodiments in accordance with the second aspect of the present inventive subject matter, which can include or not include, as suitable, any of the other features described herein, the first holding structure comprises at least a first keying structure. In some of such embodiments, the first keying structure comprises at least a first recess or opening, and/or in some of such embodiments, the first keying structure comprises at least a first protrusion.

In accordance with a third aspect of the present inventive subject matter, there is provided a lamp comprising:

at least a first lighting device corresponding to any lighting devices described herein; and at least a first power input assembly corresponding to any power input assembly described herein.

In accordance with a fourth aspect of the present inventive subject matter, there is provided a method of connecting a power input assembly to a lighting device, the method comprising:

engaging a second electrical connector region of a power input assembly with a first electrical connector region of a lighting device, the lighting device comprising:

at least a first light emitter; and at least a first power input assembly engagement structure that comprises:

the first electrical connector region; and at least a first power input assembly engagement region, the power input assembly comprising:

the second electrical connector region;

at least a first positioning element; and at least a first holding structure, the first positioning element releasably engaged with the first holding structure, the first electrical connector region held by the first positioning element, whereby the first electrical connector region is held in place relative to the first holding structure.

In some embodiments in accordance with the fourth aspect of the present inventive subject matter, which can include or not include, as suitable, any of the other features described herein, said engaging a second electrical connector region of a power input assembly with a first electrical connector region of a lighting device is carried out in a single step by moving the power input assembly relative to the lighting device.

In some embodiments in accordance with the fourth aspect of the present inventive subject matter, which can include or not include, as suitable, any of the other features described herein, said engaging a second electrical connector region of a power input assembly with a first electrical connector region of a lighting device is carried out by moving the power input assembly in a single direction relative to the lighting device.

In some embodiments in accordance with the fourth aspect of the present inventive subject matter, which can include or not include, as suitable, any of the other features described herein:

the first holding structure comprises at least a first lighting device engagement region, and during said engaging a second electrical connector region of a power input assembly with a first electrical connector region of a lighting device, the first lighting device engagement region engages the first power input assembly engagement region.

In some embodiments in accordance with the fourth aspect of the present inventive subject matter, which can include or not include, as suitable, any of the other features described herein:

the first holding structure comprises at least a first keying structure;

the power input assembly engagement structure comprises at least a first keying region; and during said engaging a second electrical connector region of a power input assembly with a first electrical connector region of a lighting device, the first keying structure engages the first keying region.

In accordance with a fifth aspect of the present inventive subject matter, there is provided a lighting device positioning apparatus, comprising:

a lighting device mounting region;

at least a first slide member and a second slide member; and at least a first connector, the first slide member comprising at least a first retaining structure-receiving feature, the first slide member comprising at least a first slot extending in a first direction, the second slide member comprising at least a second slot extending in a second direction, the first direction defining an angle of at least 20 degrees relative to the second direction, the first connector extending through the first slot and the second slot.

In some embodiments in accordance with the fifth aspect of the present inventive subject matter, the first direction is substantially perpendicular to the second direction.

The inventive subject matter may be more fully understood with reference to the accompanying drawings and the following detailed description of the inventive subject matter.

BRIEF DESCRIPTION OF THE DRAWING FIGURES

Figure 17:
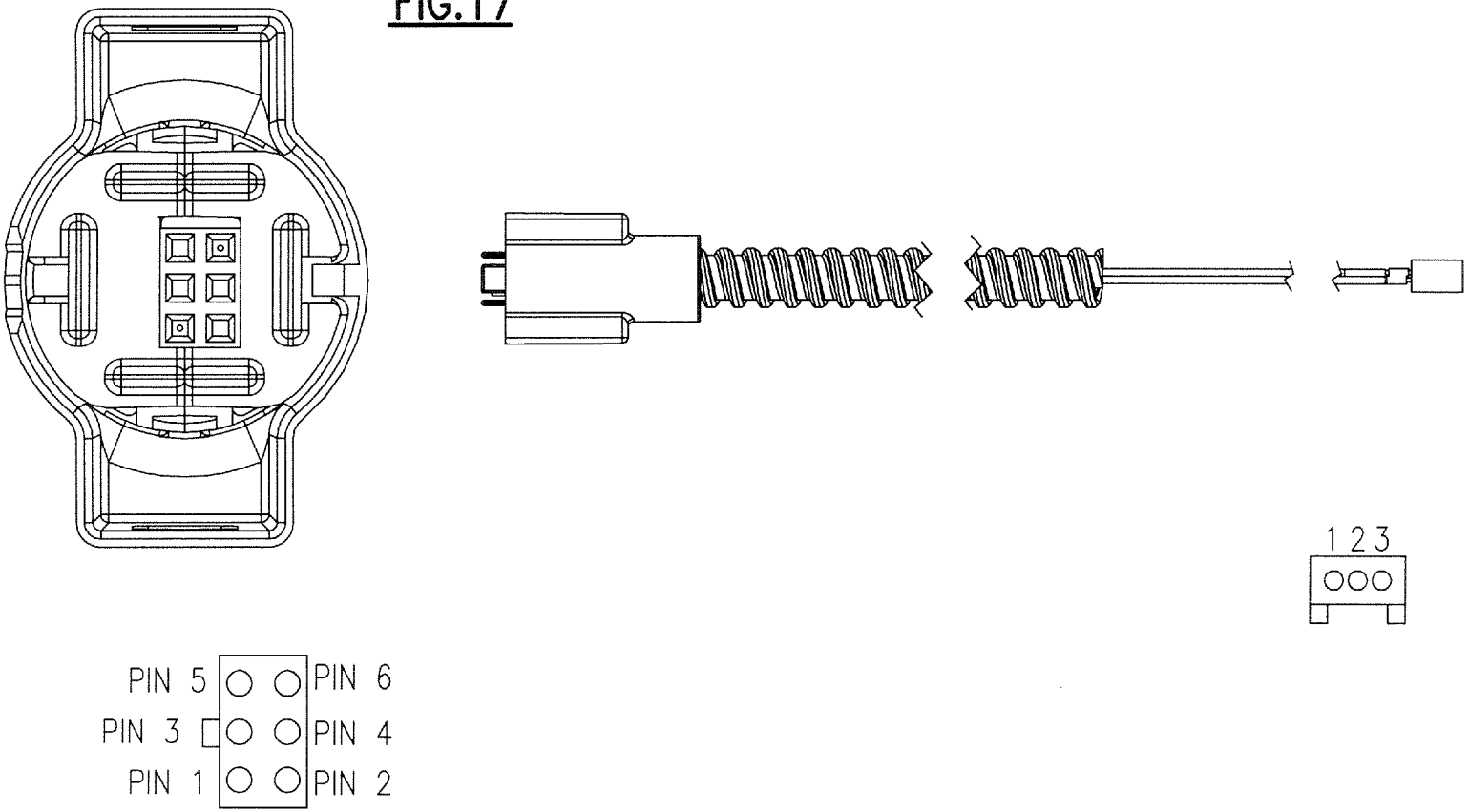
Figure 18:
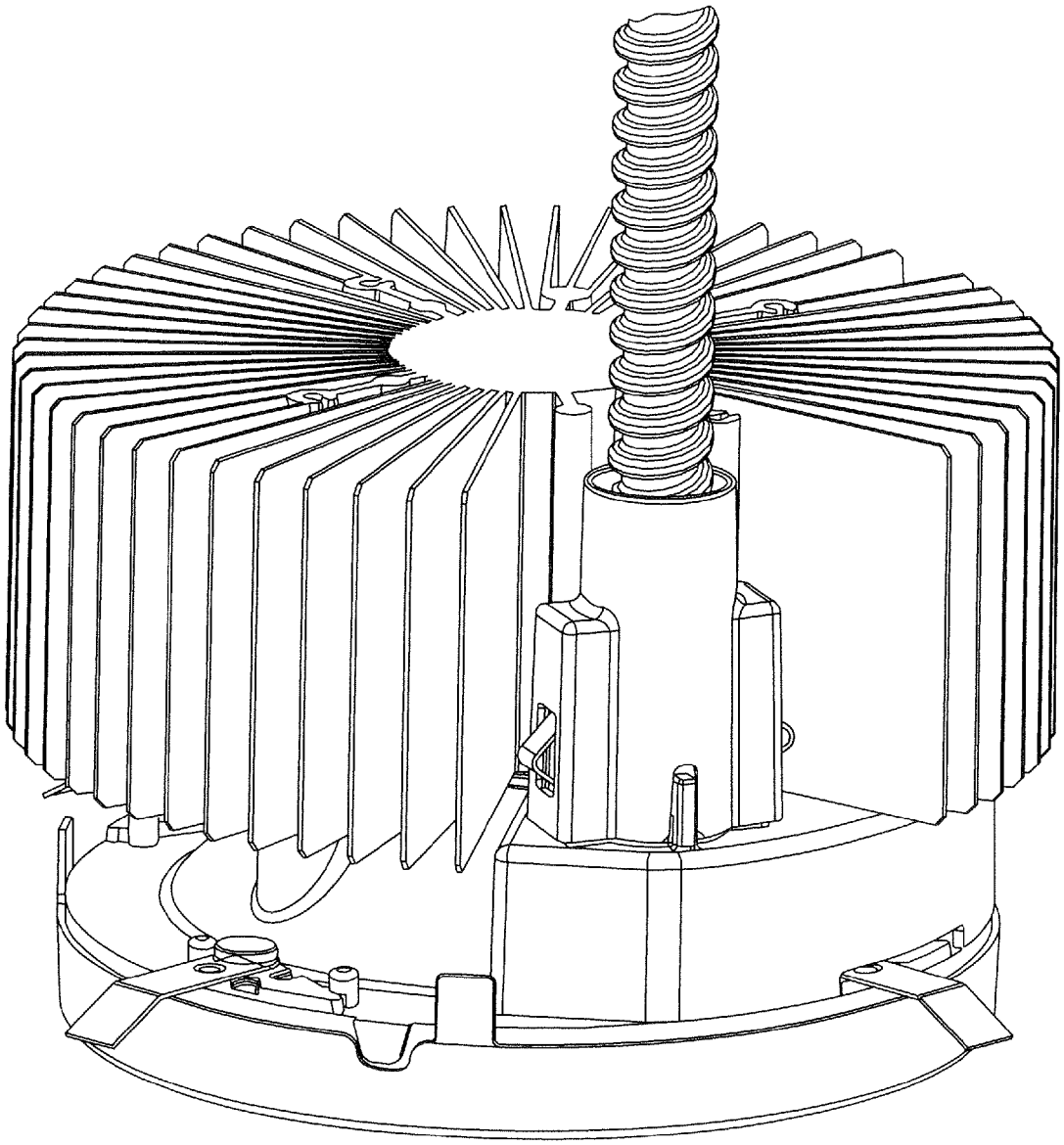
Figure 19:
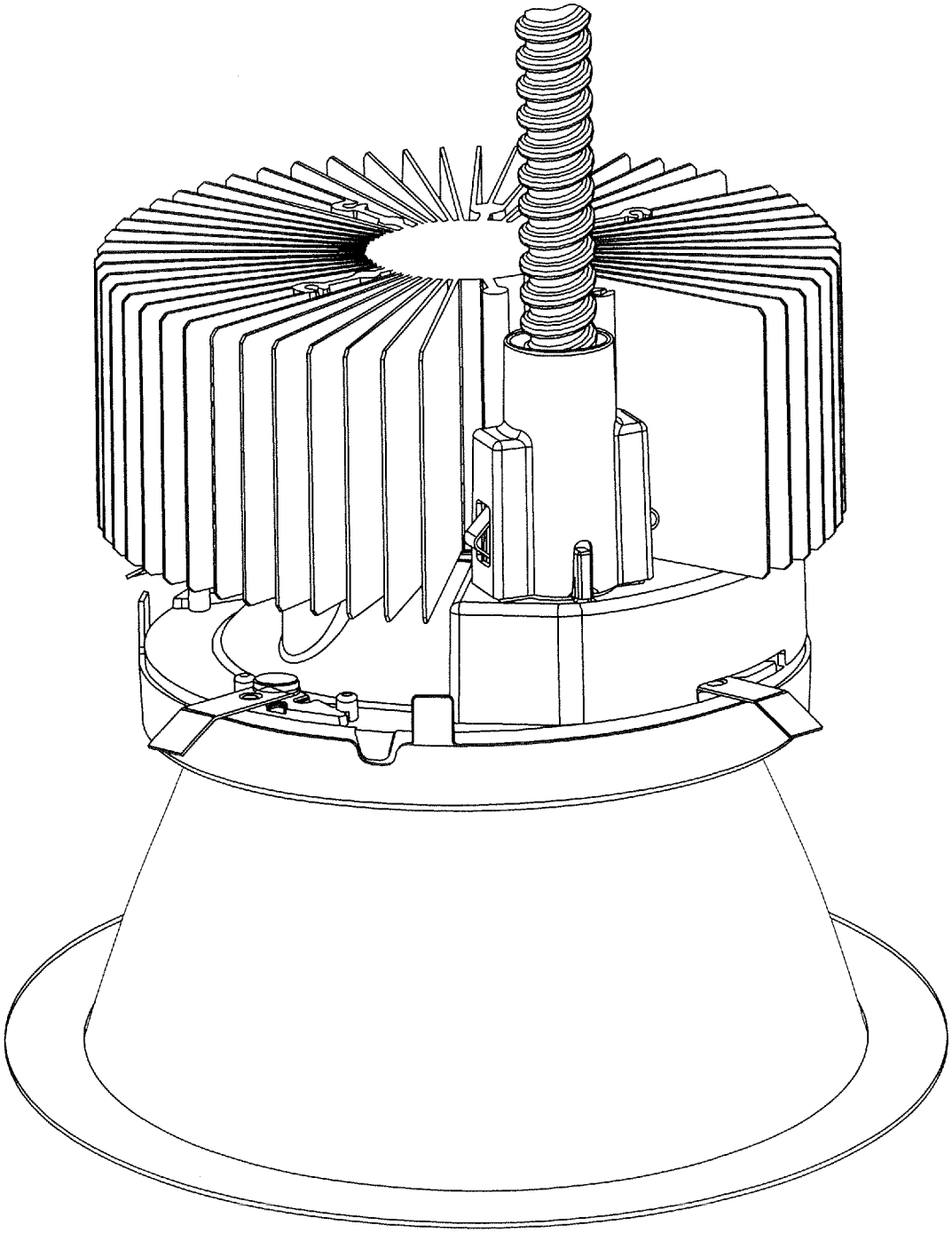
Figure 20:
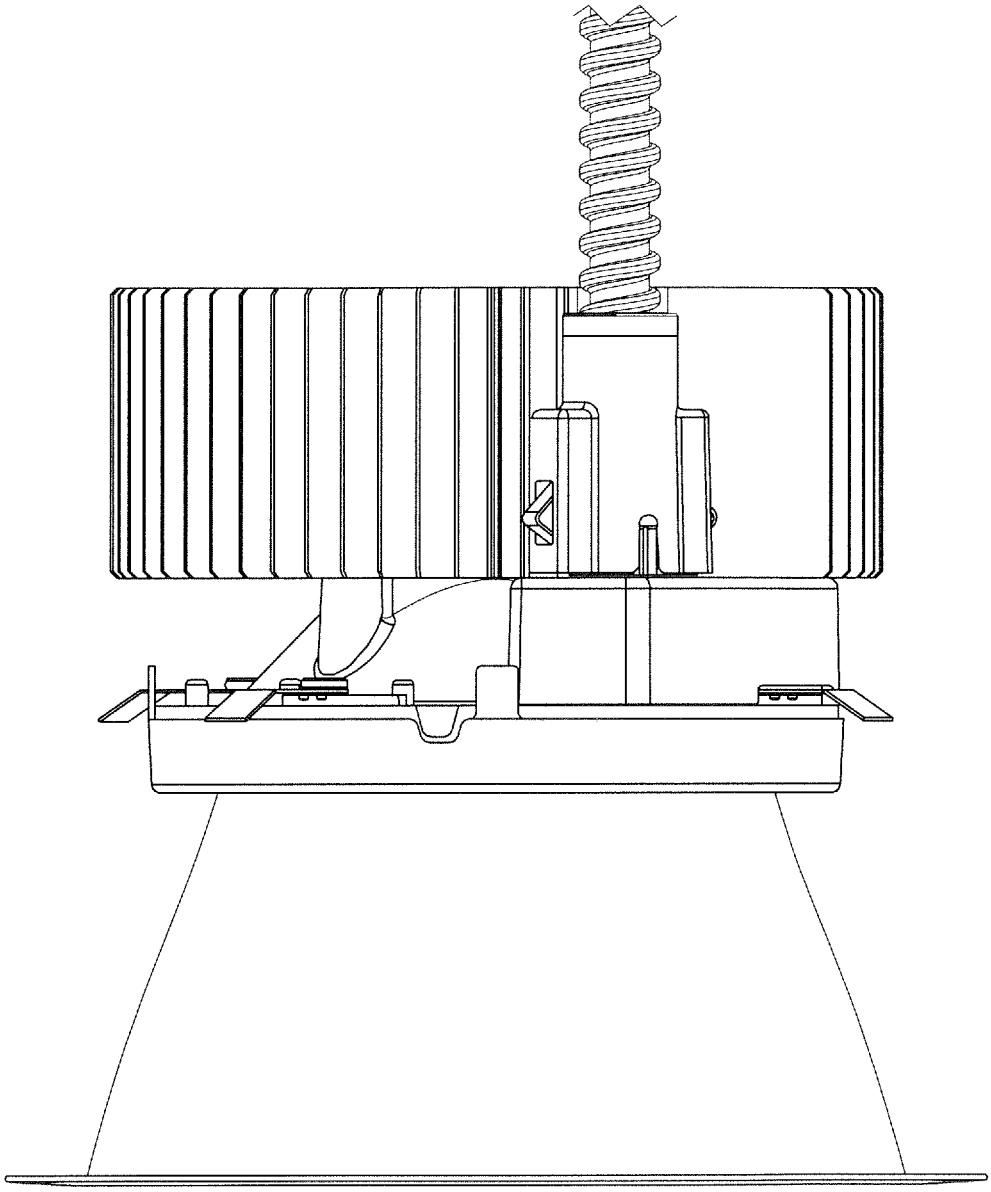
Figure 21:
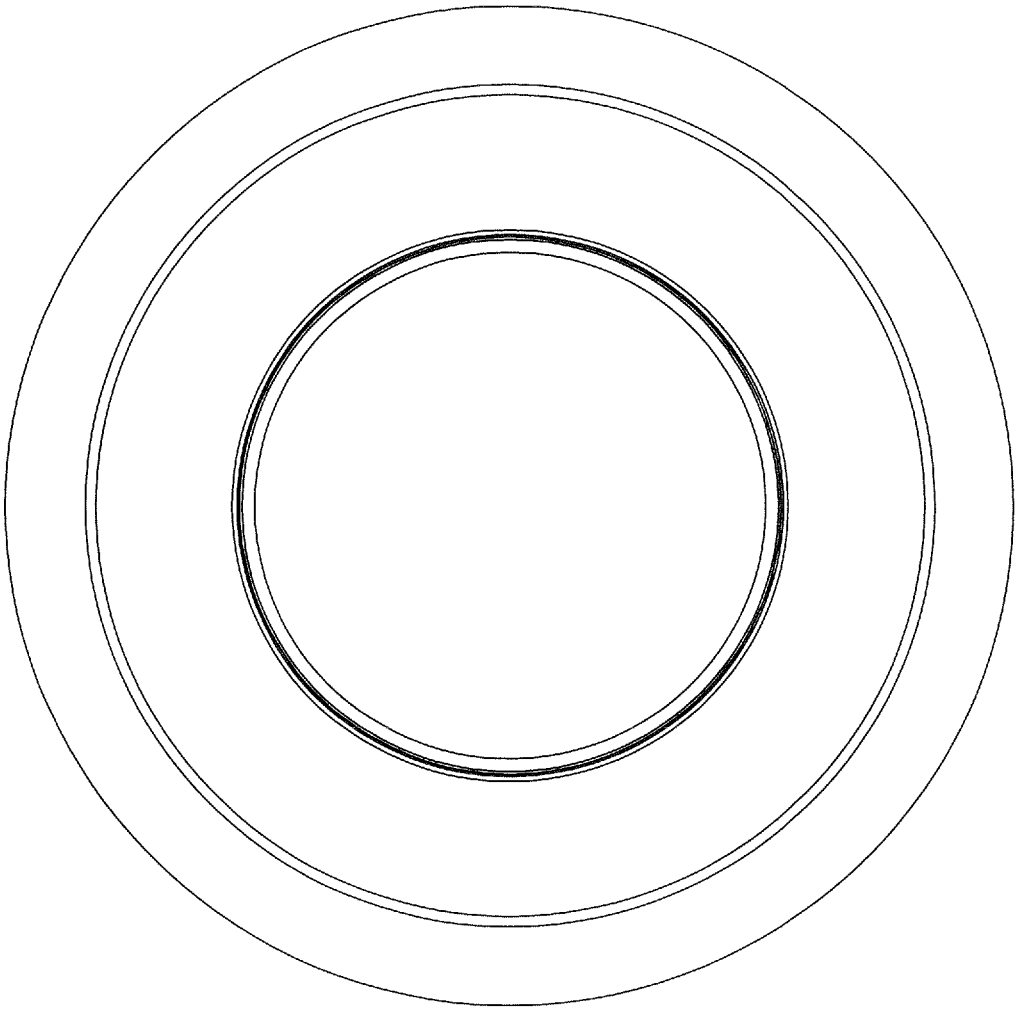
Figure 22:
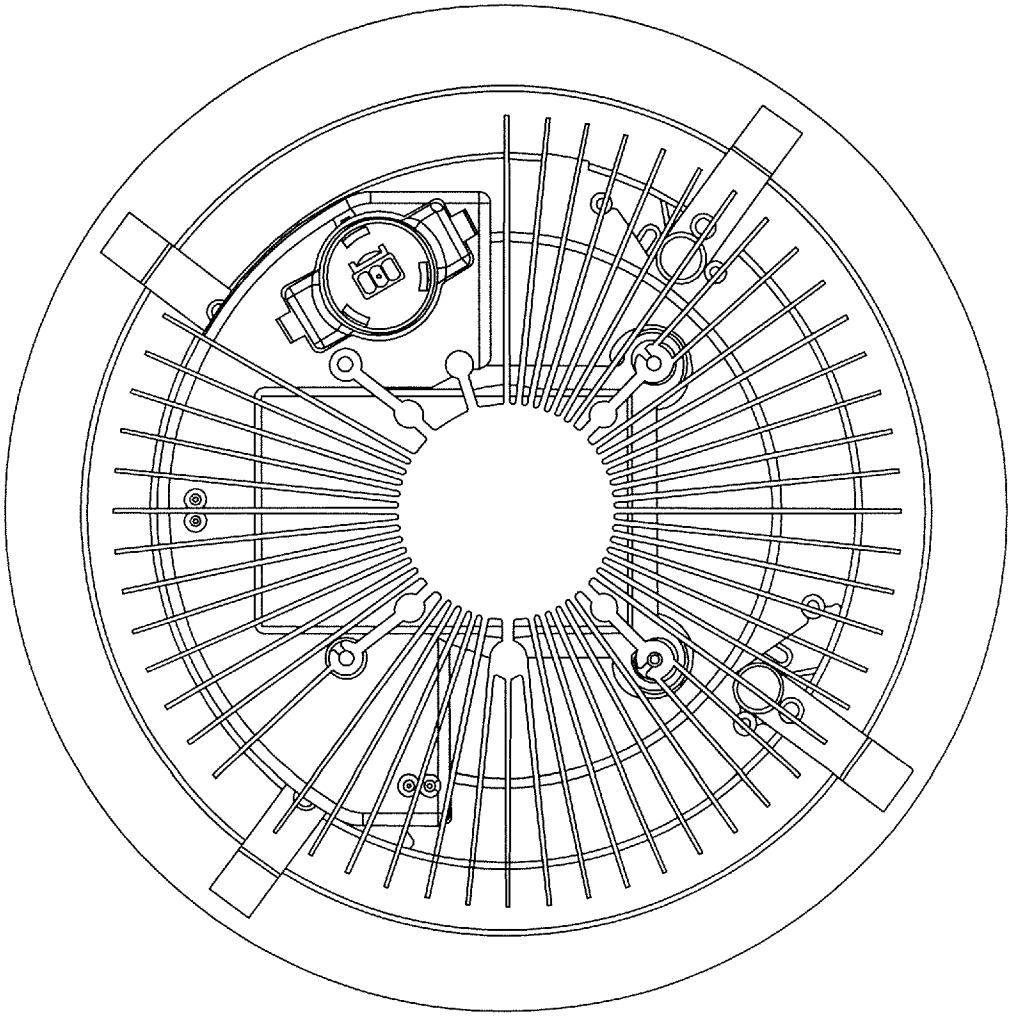
Figure 23:
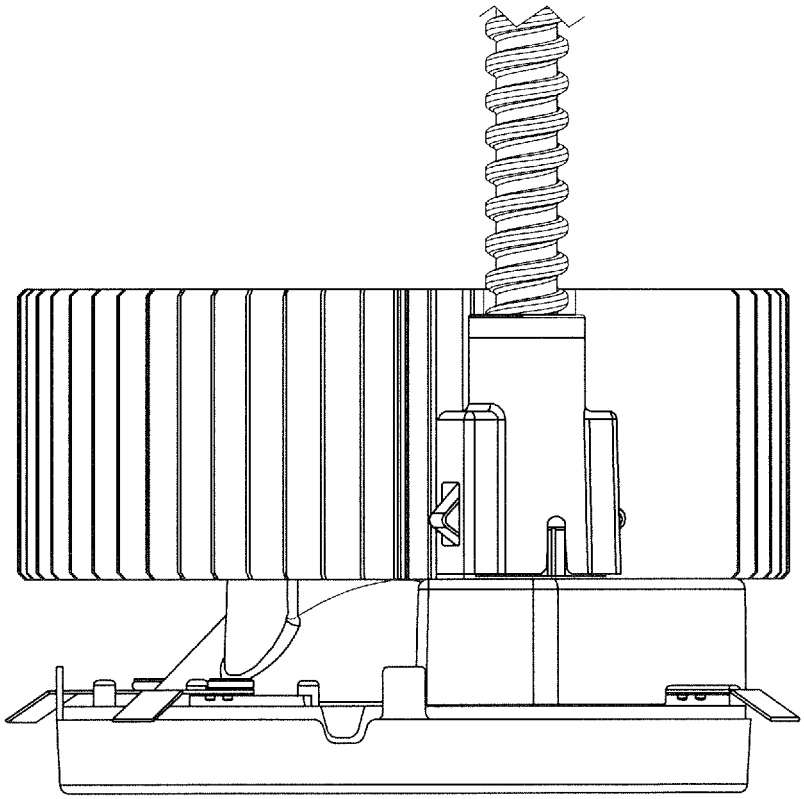
Figure 24:
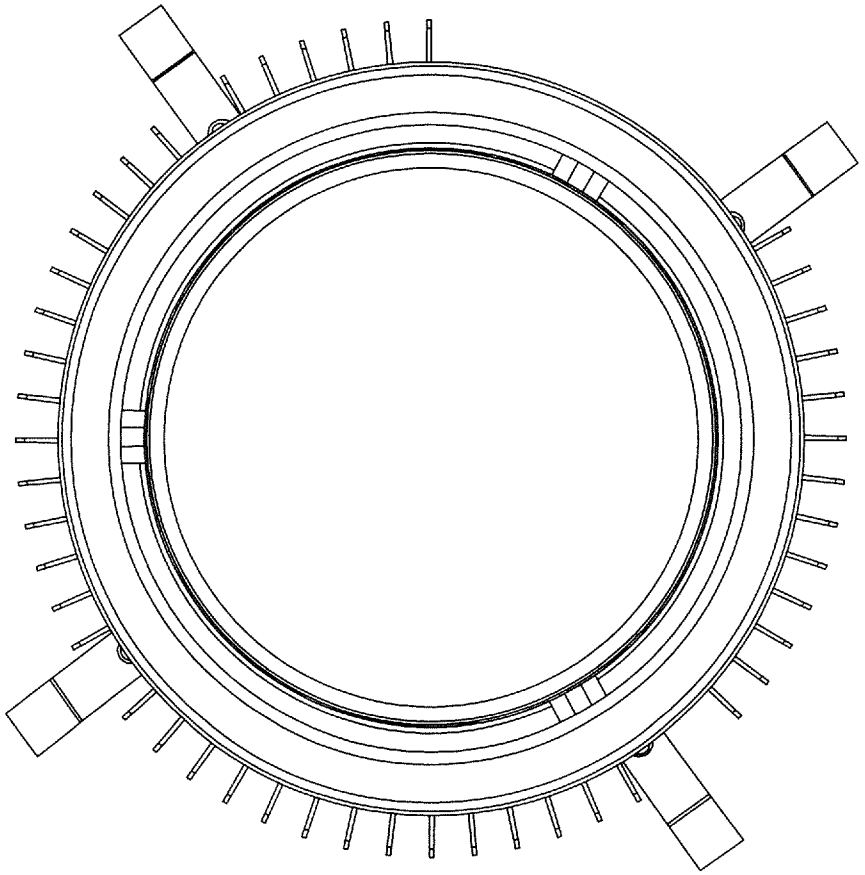
Figure 25:
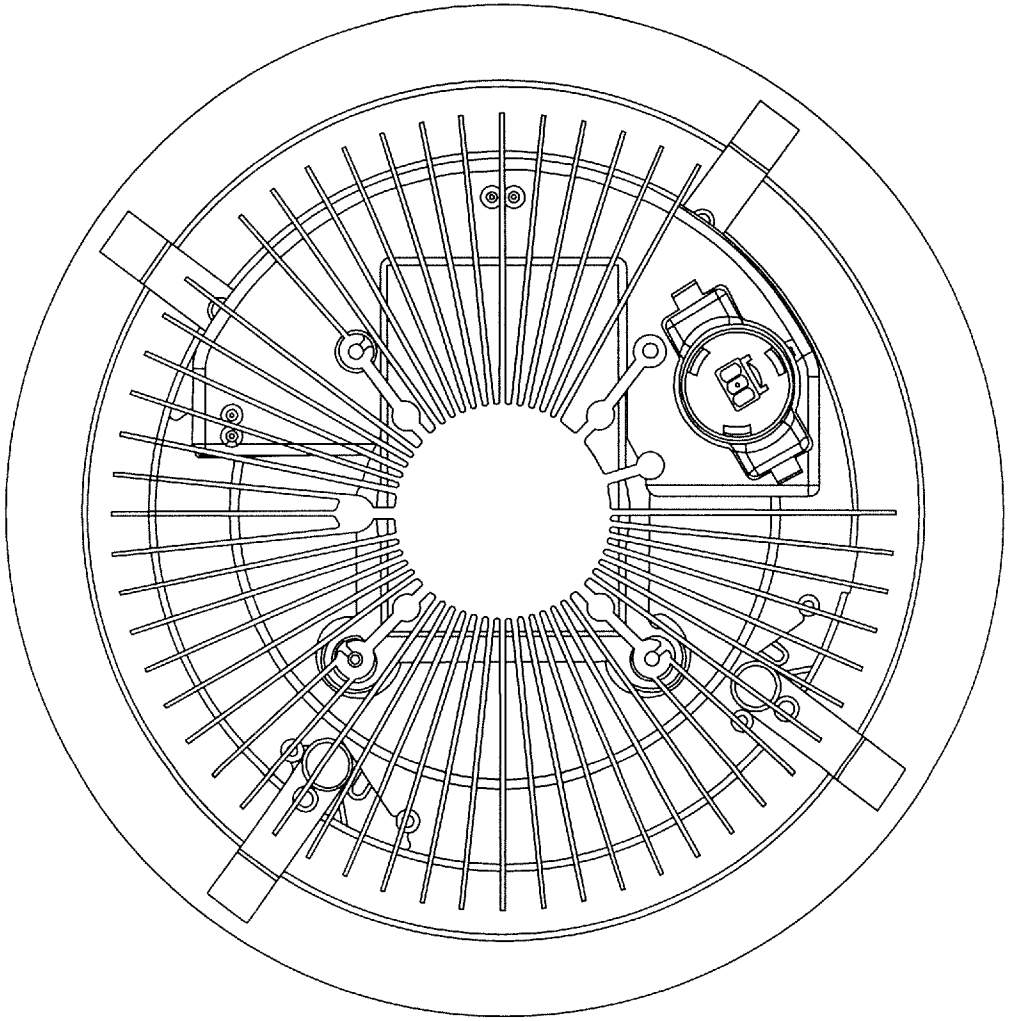

FIG. 17 schematically depicts a wiring arrangement for a lamp according to an embodiment in accordance with the present inventive subject matter.

FIGS. 18-25 are views of lamps that comprise lighting devices and power input assemblies that correspond to the present inventive subject matter.

Figure 26:
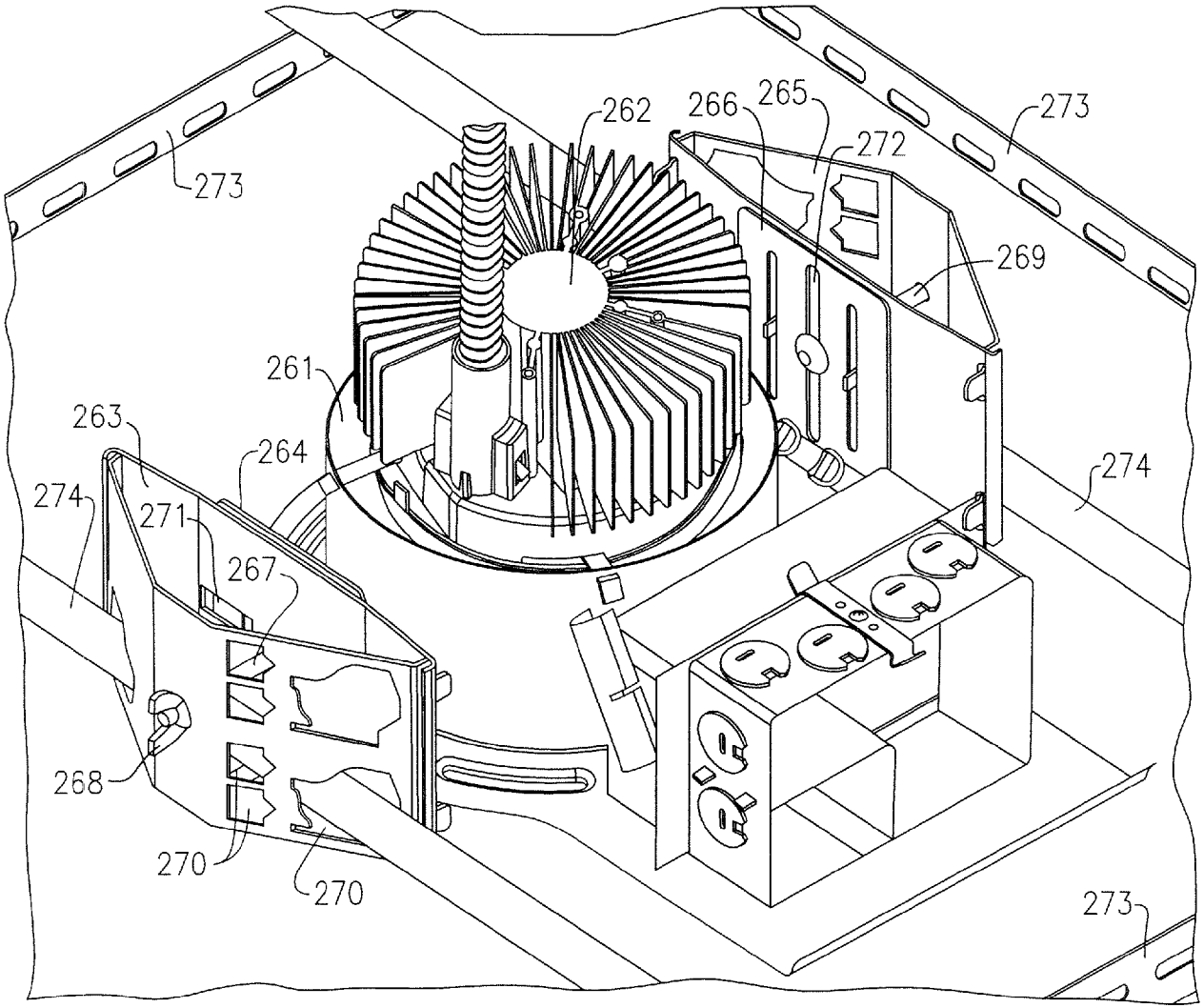

FIG. 26 is a perspective view of a lighting device positioning apparatus 260 according to an embodiment in accordance with the present inventive subject matter.

DETAILED DESCRIPTION

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can he thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

The term "region", as used herein, can refer to a portion of a component or an entire component.

The term "structure", as used herein, can refer to a single component or two or more components which can each be in contact with at least one other component in the structure, and/or in which one or more component can be spaced from the other component or components in the structure.

The expression "releasably engaged" (e.g., in the expression "releasably engaged with the first holding structure") means that a first structure (i.e., a structure that is referred to as being releasably engaged with a second structure) is inhibited from moving relative to a second structure (e.g., a force of 0.25 N, 0.50 N, 0.75 N, 1.0 N, or more can be applied to the first structure relative to the second structure and the first structure will not move substantially relative to the second structure), and that action can be taken to release that inhibition, e.g., one or more spring elements can be pivoted.

The expression "substantially parallel", as used herein, means that two lines do not diverge from each other by more than 5 degrees.

The expression "substantially co-linear", as used herein, means that two lines do not diverge from each other by more than 5 degrees, and that the two lines come within a distance from each other of not more than 5% of a largest dimension of any structure being described.

The expression "substantially perpendicular", as used herein, means that a first direction and a second direction define an angle of between 85 degrees and 95 degrees relative to each other.

The expression "light emitter", as used herein, is not limited, except that it indicates that the light emitter is a device that is capable of emitting light. That is, a light emitter can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

In some aspects according to the present inventive subject matter, e.g., the first aspect discussed above, there is provided a lighting device that comprises at least a first light emitter. In such aspects according to the present inventive subject matter, the light emitter(s) can be any suitable device capable of emitting light. Persons of skill in the art are familiar with, and have ready access to, a wide variety of light emitters (which can, e.g., emit white light, light of any suitable color, or light of a combination of different colors), and any suitable light emitters can be employed in accordance with the present inventive subject matter. Representative examples of types of light emitters include incandescent lights, fluorescent lamps, solid state light emitters (e.g., light emitting diodes), laser diodes, thin film electroluminescent devices, light emitting polymers (LEPs), halogen lamps, high intensity discharge lamps, electron-stimulated luminescence lamps, etc., with or without filters. That is, the at least one light emitter can comprise a single light emitter, a plurality of light emitters of a particular type, or any combination of one or more light emitters of each of a plurality of types.

The present inventive subject matter is applicable to lighting devices of any size or shape capable of incorporating the described heat transfer structure, including flood lights, spot lights, downlights, and all other general residential or commercial illumination products.

The lighting devices of the present inventive subject matter can be arranged in generally any suitable orientation, a variety of which are well known to persons skilled in the art. For example, the lighting device can be a back-reflecting device or a front-emitting device.

Solid state light emitters are of great importance, in view of their energy efficiency as well as other properties (e.g., their ability to be configured to achieve high CRI Ra and/or high brightness, their ability to be used to provide compact designs, etc.). Persons of skill in the art are familiar with, and have ready access to, a wide variety of solid state light emitters, and any suitable solid state light emitter (or solid state light emitters) can be employed in the lighting devices or lighting device elements according to the present inventive subject matter. Representative examples of solid state light emitters include light emitting diodes (inorganic or organic, including polymer light emitting diodes (PLEDs)) and a wide variety of luminescent materials as well as combinations (e.g., one or more light emitting diodes and/or one or more luminescent materials).

Persons of skill in the art are familiar with, have ready access to, and can readily make, a variety of solid state light emitters which, when illuminated, emit light of any of a wide variety of wavelengths, ranges of wavelengths, dominant emission wavelengths and peak emission wavelength (e.g., they can emit infrared light, visible light, ultraviolet light, near ultraviolet light, etc., and any combinations thereof), and any of such solid state light emitters, or any combinations of such solid state light emitters, can be employed as a light emitter (or as light emitters) in accordance with the present inventive subject matter.

In any lighting device according to the present inventive subject matter that comprises one or more solid state light emitters, such one or more solid state light emitters can be of any suitable size (or sizes), e.g., and any quantity (or respective quantities) of solid state light emitters of one or more sizes can be employed. In some instances, for example, a greater quantity of smaller solid state light emitters can be substituted for a smaller quantity of larger solid state light emitters, or vice-versa.

In any lighting device according to the present inventive subject matter that comprises one or more solid state light emitters, such one or more solid state light emitters can be arranged in any desired way.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks that glow in the visible spectrum upon illumination with ultraviolet light.

One or more luminescent materials, if included, can be provided in any suitable form. For example, one or more luminescent materials can be embedded in a resin (i.e., a polymeric matrix), such as a silicone material, an epoxy material, a glass material or a metal oxide material, and/or can be applied to one or more surfaces of a resin. For example, inclusion of one or more luminescent materials (if desired) can be accomplished by adding the luminescent material (or materials) to a clear or translucent encapsulant material (e.g., epoxy-based, silicone-based, glass-based or metal oxide-based material), for example by a blending or coating process.

Solid state light emitters (if employed) can be connected to the lighting device in any suitable way, e.g., by using chip on heat sink mounting techniques, by soldering (e.g., to a metal core printed circuit board (MCPCB), flex circuit or even a standard PCB, such as an FR4 board with thermal vias), for example, solid state light emitters can be mounted using substrate techniques such as from Thermastrate Ltd of Northumberland, UK. If desired, a surface of a structure or region on which one or more solid state light emitters is to be on and/or a surface (or surfaces) of the one or more solid state light emitters can be machined or otherwise formed, e.g., to be of matching topography so as to provide good adhesion and/or high heat sink surface area.

In some lighting devices, one or more solid state light emitters can be mounted directly on a portion of the lighting device, e.g., on a trim element.

In some aspects according to the present inventive subject matter, e.g., the first aspect discussed above, there is provided a lighting device that comprises one or more engagement structures. An engagement structure in accordance with the present inventive subject matter, and/or any component thereof, can comprise any suitable material or combination of materials, and persons of skill in the art can readily select suitable material or materials for use in making an engagement structure. An engagement structure, and/or any component thereof, can have any suitable shape, so long as it provides the functions that are specified for that engagement structure (or component thereof) in a particular embodiment or aspect of the present inventive subject matter.

In some aspects according to the present inventive subject matter, e.g., the first aspect discussed above, there is provided a lighting device that comprises at least one engagement structure that comprises at least one keying region, at least one electrical connector region, and at least one power input assembly engagement region. In any such aspect, the first electrical connector region can comprise any suitable electrical connector region, e.g., a first electrical connector region can comprise a plurality of conductive pins (each of the pins aligned, e.g., each having an axis that extends in a direction that is parallel to a direction in which an axis of at least one other pin extends), a plurality of recesses or openings (in which one or more regions of the surfaces that define the recesses or openings are conductive), a plurality of contacts (e.g., bumps or generally flat surfaces), etc., and/or combinations thereof. In any aspect of the present inventive subject matter that comprises two or more keying regions, the respective keying regions can be similar or different (or any number of keying regions can be similar or different). In any aspect of the present inventive subject matter that comprises two or more electrical connector regions, the respective electrical connector regions can be similar or different (or any number of electrical connector regions can be similar or different). In any aspect of the present inventive subject matter that comprises two or more power input assembly engagement regions, the respective power input assembly engagement regions can be similar or different (or any number of power input assembly engagement regions can be similar or different).

In some aspects according to the present inventive subject matter, a power input assembly engagement region comprises at least one spring element. A spring element can comprise any suitable spring element, a wide variety of which are well known to persons of skill in the art. A spring element can be any structure (1) which normally occupies a first position, (2) to which an external force can be applied to cause the spring element to move (e.g., to pivot relative to a point or line), e.g., to a second position, and (3) which moves back toward (and in some case, to) the first position when the external force is removed.

In some aspects according to the present inventive subject matter, a power input assembly engagement region comprises at least one spring element-receiving region. A spring element-receiving region can be any suitable structure capable of receiving at least a portion of a spring element, a wide variety of which (e.g., a recess or an opening) will be readily apparent to persons of skill in the art.

In some aspects according to the present inventive subject matter, e.g., the second aspect discussed above, there is provided a power input assembly that comprises at least one electrical connector region. In any such aspect, an electrical connector region can comprise any suitable electrical connector region, e.g., any of those discussed above in relation to an aspect of the present inventive subject matter that comprises a lighting device that comprises at least one electrical connector region. As noted above, in any aspect of the present inventive subject matter that comprises two or more electrical connector regions, the respective electrical connector region can be similar or different (or any number of electrical connector region s can be similar or different).

In some aspects according to the present inventive subject matter, e.g., the second aspect discussed above, there is provided a power input assembly that comprises at least one positioning element. A positioning element in accordance with the present inventive subject matter, and/or any component thereof, can comprise any suitable material or combination of materials, and persons of skill in the art can readily select suitable material or materials for use in making a positioning element. A positioning element, and/or any component thereof, can have any suitable shape, so long as it provides the functions that are specified for that positioning element (or component thereof) in a particular embodiment or aspect of the present inventive subject matter. In any aspect of the present inventive subject matter that comprises two or more positioning elements, the respective positioning elements can be similar or different (or any number of positioning elements can be similar or different).

In some aspects according to the present inventive subject matter, e.g., the second aspect discussed above, there is provided a power input assembly that comprises at least one positioning element that comprises at least one body structure. An body structure in accordance with the present inventive subject matter, and/or any component thereof, can comprise any suitable material or combination of materials, and persons of skill in the art can readily select suitable material or materials for use in making a body structure. A body structure, and/or any component thereof, can have any suitable shape, so long as it provides the functions that are specified for that body structure (or component thereof) in a particular embodiment or aspect of the present inventive subject matter. In any aspect of the present inventive subject matter that comprises two or more body structures (any of which may comprises one or more body elements), the respective body structures (or one or more body elements thereof) can be similar or different (or any number of body structures can be similar or different).

In some aspects according to the present inventive subject matter, e.g., the second aspect discussed above, there is provided a power input assembly that comprises at least one retention element that comprises at least one flex element. A flex element can comprise any suitable flex element, a wide variety of which are well known to persons of skill in the art. A flex element can be any structure (1) which normally occupies a first position, (2) to which an external force can be applied to cause the flex element to move (e.g., to pivot relative to a point or line), e.g., to a second position, and (3) which moves back toward (and in some case, to) the first position when the external force is removed.

In some aspects according to the present inventive subject matter, a power input assembly engagement region comprises at least a first spring element-receiving region. A spring element-receiving region can be any suitable structure capable of receiving at least a portion of a spring element, a wide variety of which (e.g., a recess or an opening) will be readily apparent to persons of skill in the art.

In some aspects according to the present inventive subject matter, e.g., the second aspect discussed above, there is provided a power input assembly that comprises at least one holding structure. A holding structure in accordance with the present inventive subject matter, and/or any component thereof, can comprise any suitable material or combination of materials, and persons of skill in the art can readily select suitable material or materials for use in making a holding structure. A holding structure, and/or any component thereof, can have any suitable shape, so long as it provides the functions that are specified for that holding structure (or component thereof) in a particular embodiment or aspect of the present inventive subject matter. In any aspect of the present inventive subject matter that comprises two or more holding structures, the respective holding structures can be similar or different (or any number of holding structures can be similar or different).

In some aspects according to the present inventive subject matter, there is provided a power input assembly that comprises at least a first holding structure and at least a first positioning element, in which the first positioning element comprises at least one flex element and in which the first holding structure comprises at least one flex element engagement structure, the first flex element releasably engaged with the first flex element engagement structure. A flex element engagement structure can be any suitable structure capable of receiving at least a portion of a flex element, a wide variety of which (e.g., a recess or an opening) will be readily apparent to persons of skill in the art.

In some aspects according to the present inventive subject matter, there is provided a power input assembly that comprises at least one holding structure that comprises at least one lighting device engagement region. A lighting device engagement region in accordance with the present inventive subject matter, and/or any component thereof, can comprise any suitable material or combination of materials, and persons of skill in the art can readily select suitable material or materials for use in making a lighting device engagement region. A lighting device engagement region, and/or any component thereof, can have any suitable shape, so long as it provides the functions that are specified for that lighting device engagement region (or component thereof) in a particular embodiment or aspect of the present inventive subject matter. In any aspect of the present inventive subject matter that comprises two or more lighting device engagement regions, the respective lighting device engagement regions can be similar or different (or any number of lighting device engagement regions can be similar or different). For example, in some embodiments, a lighting device engagement region can comprise a spring element that is configured to be received in an engagement region receiving structure (e.g., on a lighting device), while in some embodiments, a lighting device engagement region can comprise an opening or a recess that is configured to receive a spring element (e.g., on a lighting device), and in some embodiments, combinations of such structures can be provided. Alternatively or additionally, friction fitting (or any other suitable mechanical engagement) can be employed in place or (or in addition to) and flex element or spring element and corresponding receiving element.

In some aspects according to the present inventive subject matter, there is provided a power input assembly that comprises at least one electrical conductor. Persons of skill in the art are familiar with a variety of electrical conductors (e.g., wires and various assemblies that include wires, traces, conductive tracks, buses, etc.), and any suitable electrical conductor(s) can be employed in aspects that comprise one or more electrical conductors.

In some aspects according to the present inventive subject matter, there is provided a power input assembly that comprises at least one conduit, through at least a portion of which one or more electrical conductors can extend or be fed. Persons of skill in the art are familiar with a variety of conduits (e.g., corrugated metal conduits (e.g., Kaiphoneflex), e.g., helically corrugated metal conduits), and any suitable conduit(s) cam be employed in aspects that comprise one or more conduits.

In some aspects according to the present inventive subject matter, e.g., the third aspect discussed above, there is provided a lamp that comprises at least one lighting device that corresponds to any of the lighting devices described herein and (2) at least one power input assembly that corresponds to any of the power input assemblies described herein.

Lamps and lighting devices in accordance with the present inventive subject matter can comprise any suitable circuitry, including any suitable dimming circuitry, any suitable power supply circuitry, any suitable driver circuitry, any suitable wiring pattern, any suitable circuitry for achieving a degree of voltage matching, color maintenance circuitry, power factor correction circuitry.

Lamps and lighting devices in accordance with the present inventive subject matter can comprise any suitable housing structures, fixture components, enclosing structures, light mixing chambers, etc.

Lamps and lighting devices in accordance with the present inventive subject matter can comprise any suitable heat dissipation features or components, a wide variety of which are well known to persons of skill in the art (including wide varieties of passive and active (i.e., requiring supply of energy for the component(s) to operate) cooling components).

Lamps and lighting devices in accordance with the present inventive subject matter can comprise one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lamp or a lighting device according to the present inventive subject matter can be selected to have any desired effect on incident light (or no effect), such as focusing, diffusing, etc. Any such lens and/or diffuser and/or light control element can comprise one or more luminescent materials, e.g., one or more phosphor.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lamp or lighting device, and the diffuser can comprise one or more luminescent material (e.g., in particulate form) spread throughout a portion of the diffuser or an entirety of the diffuser.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed.

In addition, one or more scattering elements (e.g., layers) can optionally be included in the lamps and lighting devices according to the present inventive subject matter. For example, a scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

In some aspects of the present inventive subject matter, there are provided lamps and lighting devices that provide good efficiency. In some embodiments, there are provided lamps and lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some embodiments at least 80, at least 85, at least 90 or at least 95).

The lamps and lighting devices according to the present inventive subject matter can direct light in any desired range of directions.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular (or cylindrical) in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 1:
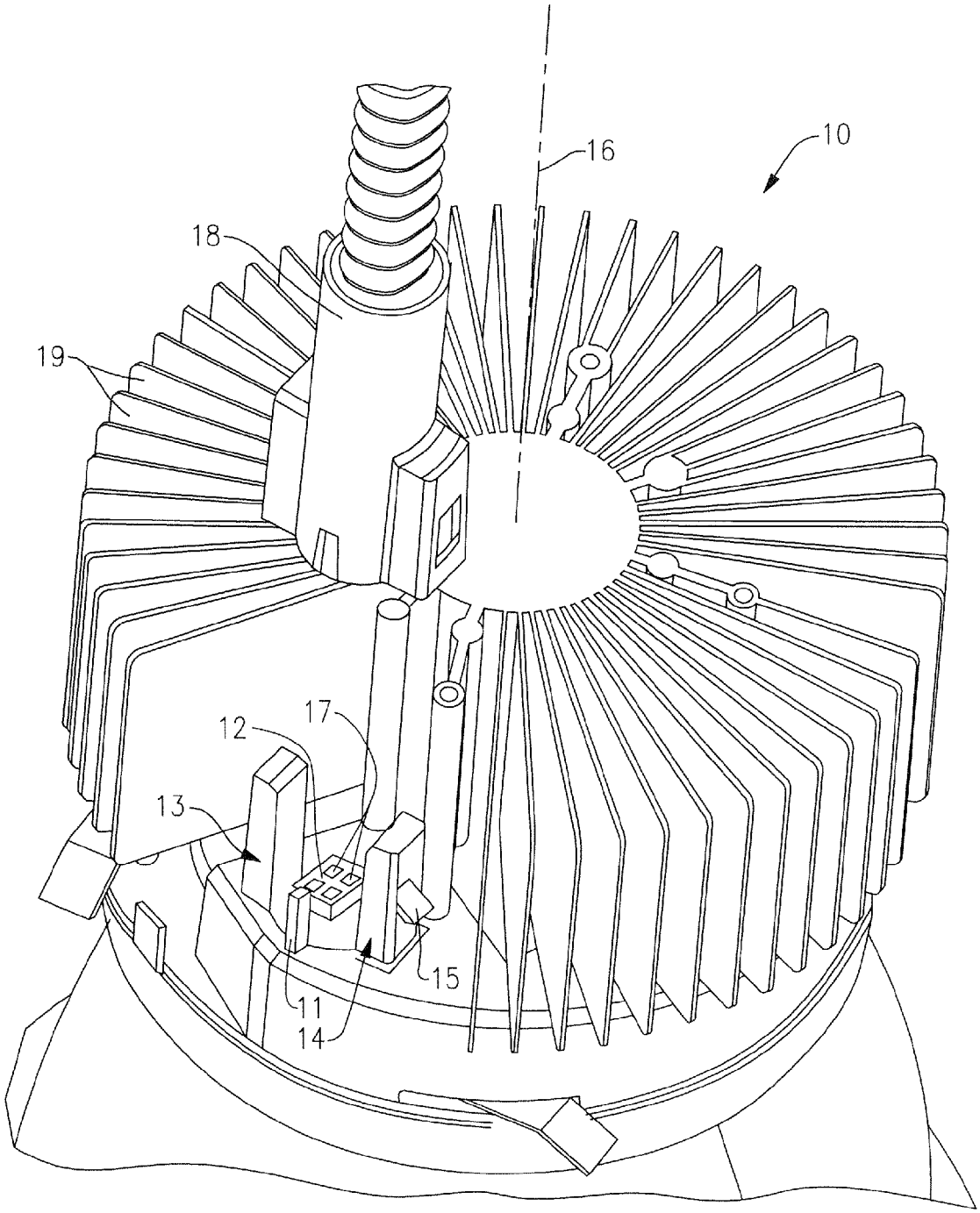
FIG. 1 is a top perspective view of a portion of a lighting device 10 in accordance with the present inventive subject matter.

FIG. 1 is a top perspective view of a portion of a lighting device 10 in accordance with the present inventive subject matter (FIG. 1 also depicts a power input assembly 18 poised for connection to the lighting device 10). Referring to FIG. 1, the lighting device 10 comprises a power input assembly engagement structure that comprises a keying region 11, a first electrical connector region 12, a first power input assembly engagement region 13 and a second power input assembly engagement region 14.

The first electrical connector region 12 comprises a plurality (namely, six) of conductive pins 17.

The lighting device 10 comprises a plurality of heat dissipating fins 19.

The first power input assembly engagement region 13 comprises a first spring element (not visible in FIG. 1), and the second power input assembly engagement region 14 comprises a second spring element 15. As shown in FIG. 1, the first and second power input assembly engagement regions 13 and 14 are on opposite sides relative to the first electrical connector region 12. As shown in FIG. 1, the keying region 11 comprises a first protrusion that extends in a direction substantially parallel to an axis 16 of the lighting device 10.

Figure 2:
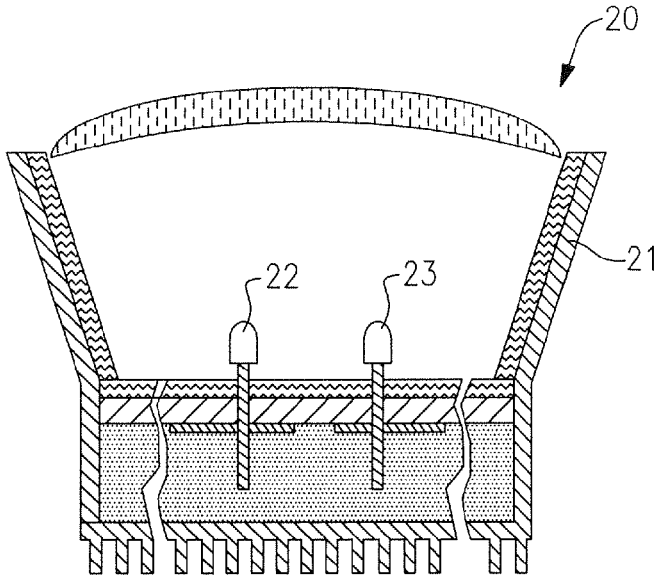
FIG. 2 is a sectional view of a portion of a lighting device 20 in accordance with the present inventive subject matter.

FIG. 2 is a sectional view of a portion of a lighting device 20 in accordance with the present inventive subject matter. Referring to FIG. 2, the lighting device 20 comprises a trim element 21, a first light emitter 22, and a second light emitter 23.

Figure 3:
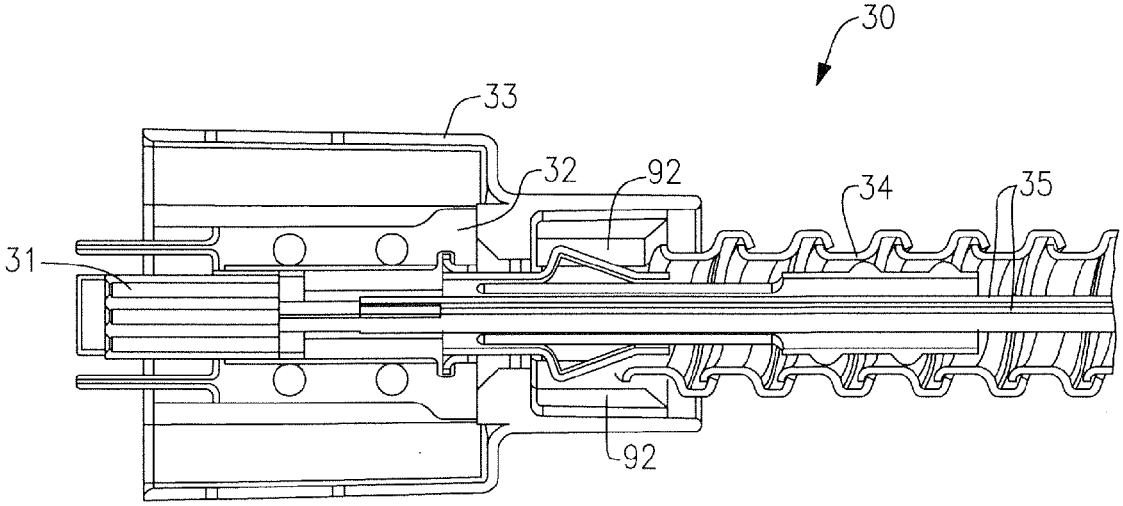
FIG. 3 is a sectional view of a power input assembly 30 in accordance with the present inventive subject matter.

FIG. 3 is a sectional view of a power input assembly 30 in accordance with the present inventive subject matter. Referring to FIG. 3, the power input assembly 30 comprises a second electrical connector region 31, a positioning element 32, a holding structure 33, a conduit 34 and first and second electrical conductors 35 (in the form of wires) that extend through the conduit 34.

Figure 4:
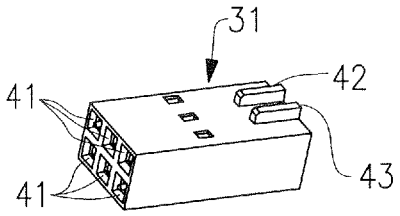
FIG. 4 is a perspective view of an electrical connector region 31 according to an embodiment in accordance with the present inventive subject matter.

The second electrical connector region 31 is shown by itself in FIG. 4. The positioning element 32 comprises a first body structure (which comprises a first body element 50 shown in FIG. 5, a second body element 60 shown in FIG. 6, and a retention element 70 shown in FIG. 7).

Referring to FIG. 4, the second electrical connector region 31 comprises a plurality of recesses 41, each with internal walls having conductive portions (which are respectively engageable with the pins 17 in the first electrical connector region 11), an alignment structure 42 in the form of a protrusion, and an alignment structure 43 also in the form of a protrusion.

Figure 5:
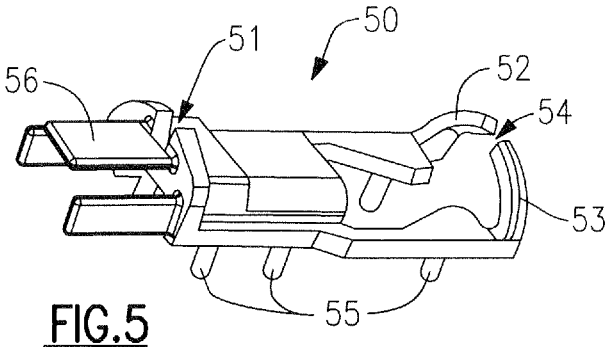
FIG. 5 is a perspective view of a first body element 50 according to an embodiment in accordance with the present inventive subject matter.

Referring to FIG. 5, the first body element 50 comprises a first indexing feature 51, a flexible structure 52, a flexible structure 53, a gap 54 defined between the flexible structure 52 and the flexible structure 53, and a plurality of pins 55.

Figure 6:
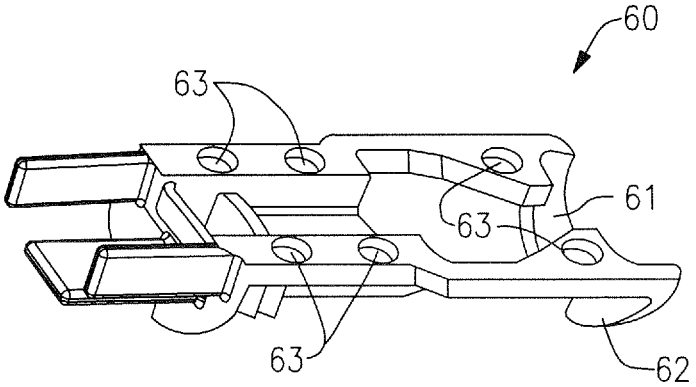
FIG. 6 is a perspective view of a second body element 60 according to an embodiment in accordance with the present inventive subject matter.

Referring to FIG. 6, the second body element 60 comprises a flexible structure 61, a flexible structure 62, and a plurality of pin receiving regions 63. In the power input assembly 30, the pins 55 extend through respective pin receiving regions 63 as far as possible.

Figure 8:
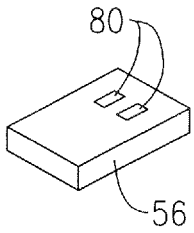
FIG. 8 is a perspective view of a portion of an underside of a second electrical connector region engagement structure 56 according to an embodiment in accordance with the present inventive subject matter.

The first body element 50 has a pair of recesses on the underside of the second electrical connector region engagement structure 56. FIG. 8 depicts a portion of the underside of the second electrical connector region engagement structure 56, and it shows this pair of recesses 80 on the underside of the second electrical connector region engagement structure 56.

Figure 7:
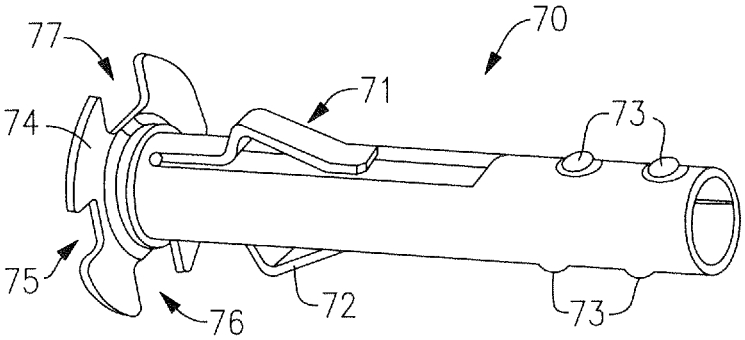
FIG. 7 is a perspective view of a retention element 70 according to an embodiment in accordance with the present inventive subject matter.

Referring to FIG. 7, the retention element 70 comprises a first flex element 71, a second flex element 72, a plurality of conduit engagement structures 73 and a first flange 74. The first flange 74 comprises a first notch 75, a second notch 76 and a third notch 77. The respective conduit engagement structures 73 are engaged by respective regions of the conduit 34.

Figure 9:
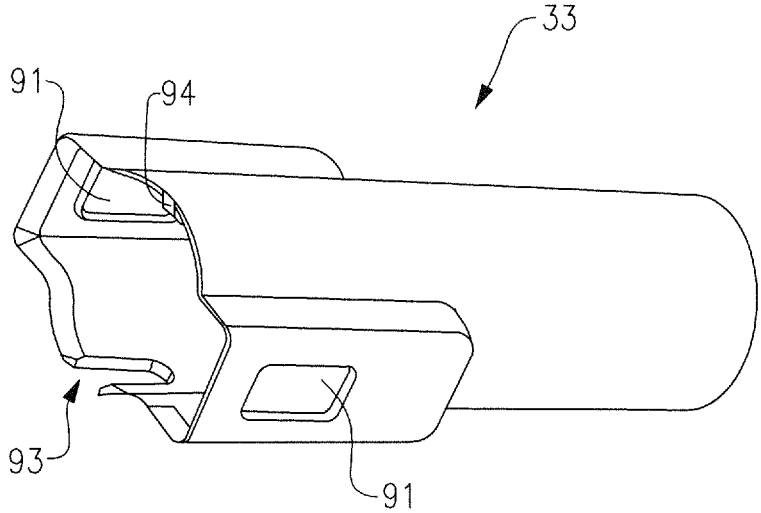
FIG. 9 is a perspective view of a holding structure 33 according to an embodiment in accordance with the present inventive subject matter.

The holding structure 33 is shown by itself in FIG. 9. Referring to FIG. 9, the holding structure 33 comprises first and second lighting device engagement regions, each in the form of an opening 91, first and second flex element-receiving regions 92 (see FIG. 3), a keying structure 93 (in the form of a recess), and a second indexing feature 94 (in the form of a ridge that extends from one end of the holding structure 33 toward the other end, roughly in a direction parallel to the direction that the electrical conductors 35 extend). A portion of the first power input assembly engagement region 13 extends through one of the openings 91, and a portion of the second power input assembly engagement region 14 extends through the other of the openings 91, thereby mechanically holding the holding structure 33 in place relative to the lighting device 10. The keying structure 93 is engaged with the keying region 11, serving to guide the power input assembly 30 relative to the lighting device 10 during assembly. The second indexing feature 94 is engaged with (1) the first indexing feature 51, the gap 54 and the first notch 75, thereby inhibiting rotation of the first positioning element 32 relative to the holding structure 33, and ensuring proper alignment of the second electrical connector region 41 relative to the first electrical connector region 12 (which can ensure proper electrical polarity). Portions of the first body element 50 and the second body element 60 are engaged in the second notch 76, and other portions of the first body element 50 and the second body element 60 are engaged in the third notch 77 (see FIG. 14).

Figure 10:
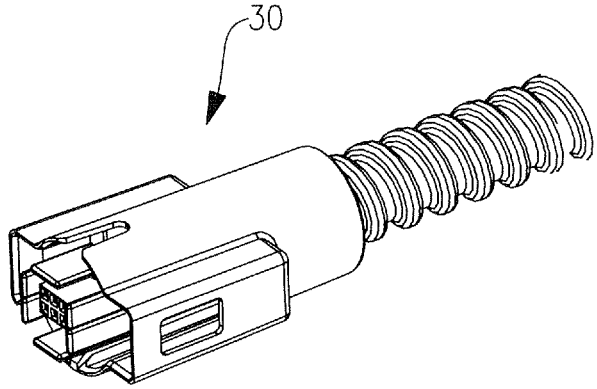
FIG. 10 is a perspective view of a power input assembly 30 according to an embodiment in accordance with the present inventive subject matter.

FIG. 10 is a perspective view of the power input assembly 30.

Figure 11:
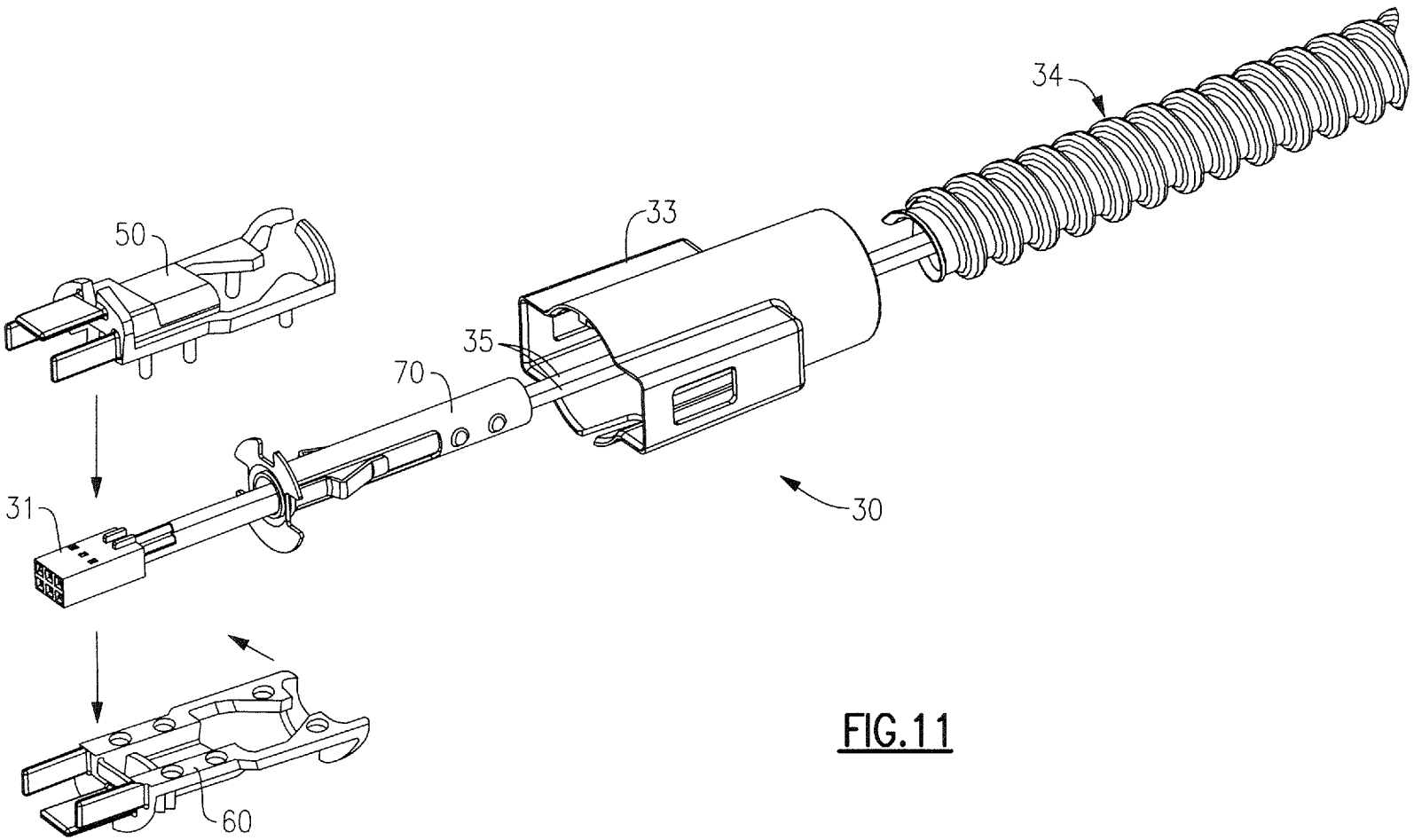
FIG. 11 is an exploded view of a power input assembly 30 according to an embodiment in accordance with the present inventive subject matter.

FIG. 11 is an exploded view of the power input assembly 30.

Figure 12:
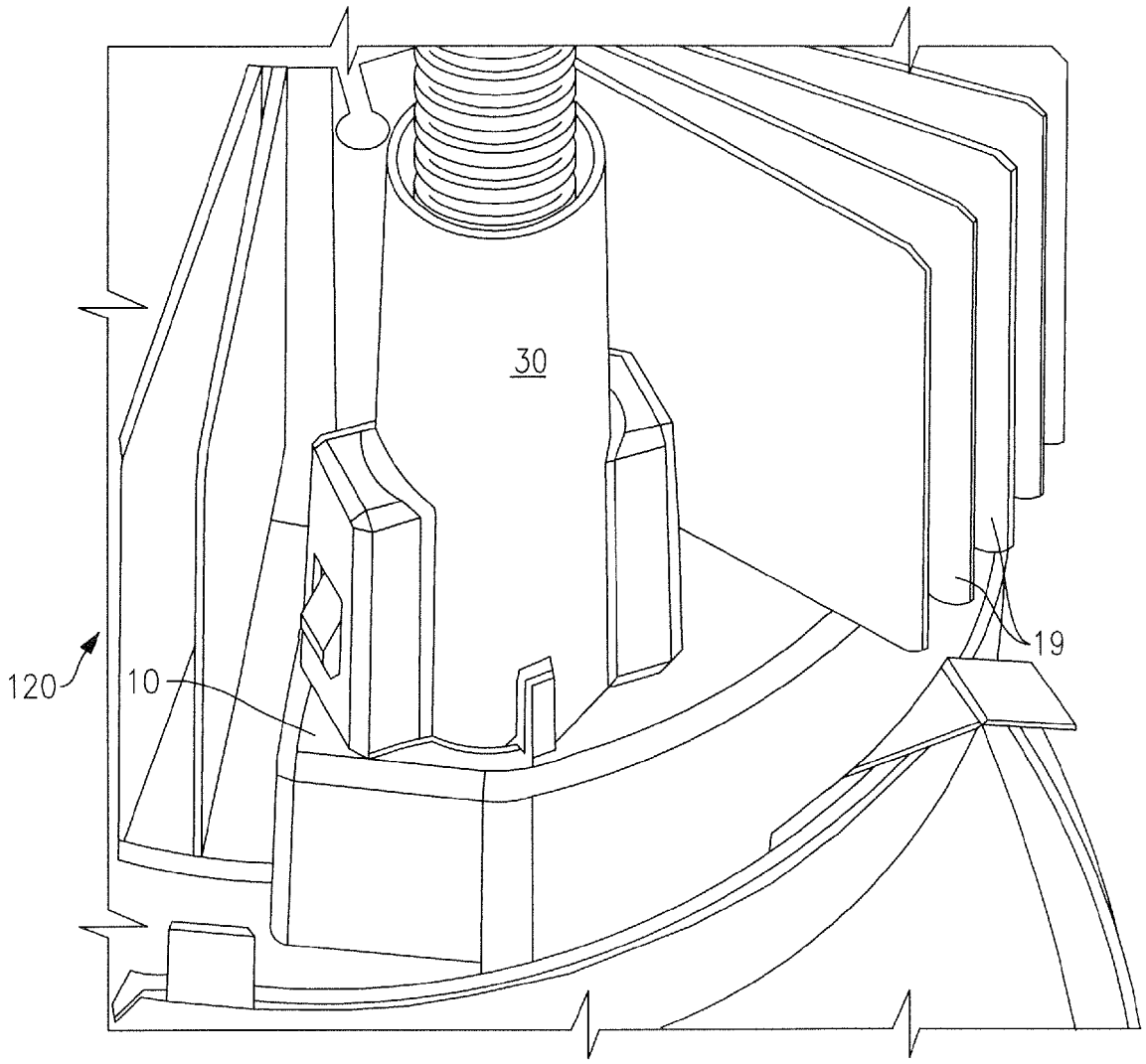
FIG. 12 is a perspective view showing a portion of a lamp 120 according to an embodiment in accordance with the present inventive subject matter.

FIG. 12 is a perspective view showing a portion of a lamp 120 comprising the lighting device 10 (depicted in FIG. 1) and the power input assembly 30 (depicted in FIG. 3).

In a method of connecting the power input assembly 30 to the lighting device 10, the method comprises engaging the second electrical connector region 31 of the power input assembly 30 with the first electrical connector region 12 of the lighting device 10. The engaging of the second electrical connector region 31 with the first electrical connector region 12 can be carried out in a single step (1) by moving the power input assembly 30 in a first direction relative to the lighting device 10, or (2) by moving the lighting device 10 in an opposite direction relative to the power input assembly 30, or (3) by both (1) and (2), or (4) by moving the power input assembly 30 in the first direction farther than the lighting device 10 is moved in an opposite direction, or (5) by moving the lighting device 10 in the opposite direction farther than the power input assembly 30 is moved in the first direction.

During the engaging of the second electrical connector region 31 with the first electrical connector region 12, the first lighting device engagement region 91 engages the first power input assembly engagement region 13 and the second lighting device engagement region 91 engages the second power input assembly engagement region 14.

During the engaging of the second electrical connector region 31 with the first electrical connector region 12, the keying structure 93 engages the first keying region 11.

During the engaging of the second electrical connector region 31 with the first electrical connector region 12, the plurality of conductive pins 17 each have axes that extend in a direction substantially parallel with the first direction.

During the engaging of the second electrical connector region 31 with the first electrical connector region 12, the plurality of recesses 41 each have axes that extend in a direction substantially parallel with the first direction (i.e., respective axes of the conductive pins 17 are co-linear with respective axes of the recesses 41).

In a representative method of retrofitting a lighting device and/or a power input assembly into an existing installation, it might be necessary (e.g., if there are an existing conduit and electrical conductors) to connect the existing conductors to the second electrical connector region, then feed the conductors through the retention element and the holding structure, and then connect the first body element and the second body element to the second electrical connector region, and then connect the first body structure to the retention element and connect the retention element to the holding structure (in any suitable order).

Figure 13:
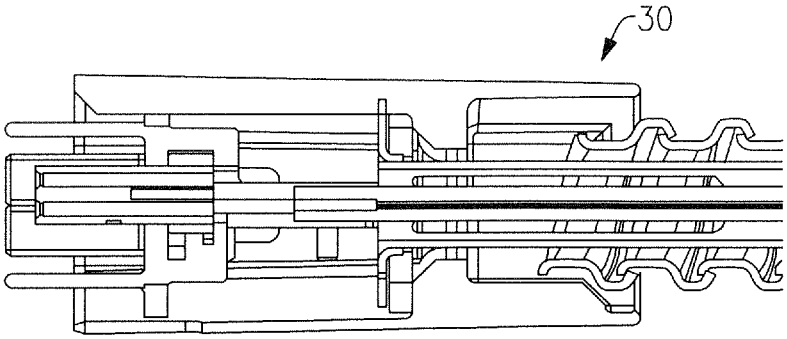
FIG. 13 is a perspective view showing a portion of a power input assembly 30 according to an embodiment in accordance with the present inventive subject matter.

FIG. 13 is a perspective view showing a portion of the power input assembly 30.

Figure 14:
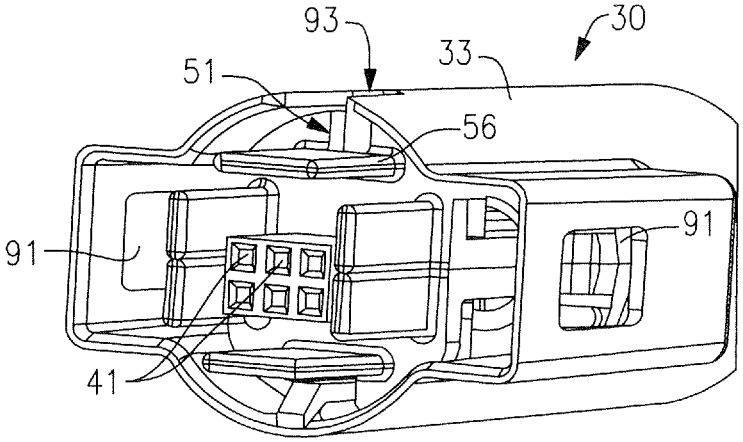
FIG. 14 is a perspective view showing a portion of a power input assembly 30 according to an embodiment in accordance with the present inventive subject matter.

FIG. 14 is a perspective view showing a portion of the power input assembly 30, in which like reference numbers are used to designate components and/or regions that are analogous to components and/or regions depicted in other drawing figures.

Figure 15:
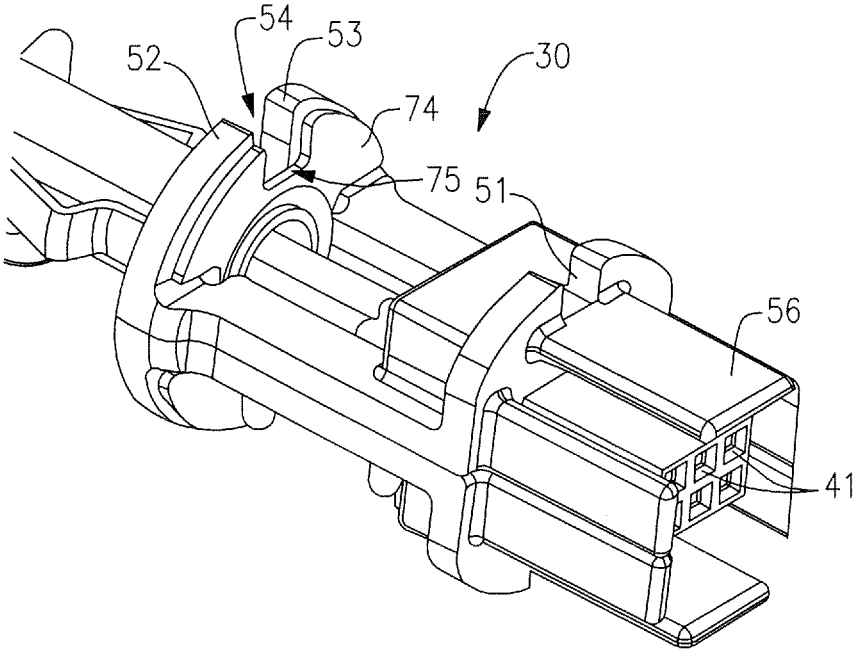
FIG. 15 is a perspective view showing a portion of a power input assembly 30 according to an embodiment in accordance with the present inventive subject matter.

FIG. 15 is a perspective view showing a portion of the power input assembly 30, in which like reference numbers are used to designate components and/or regions that are analogous to components and/or regions depicted in other drawing figures.

Figure 16:
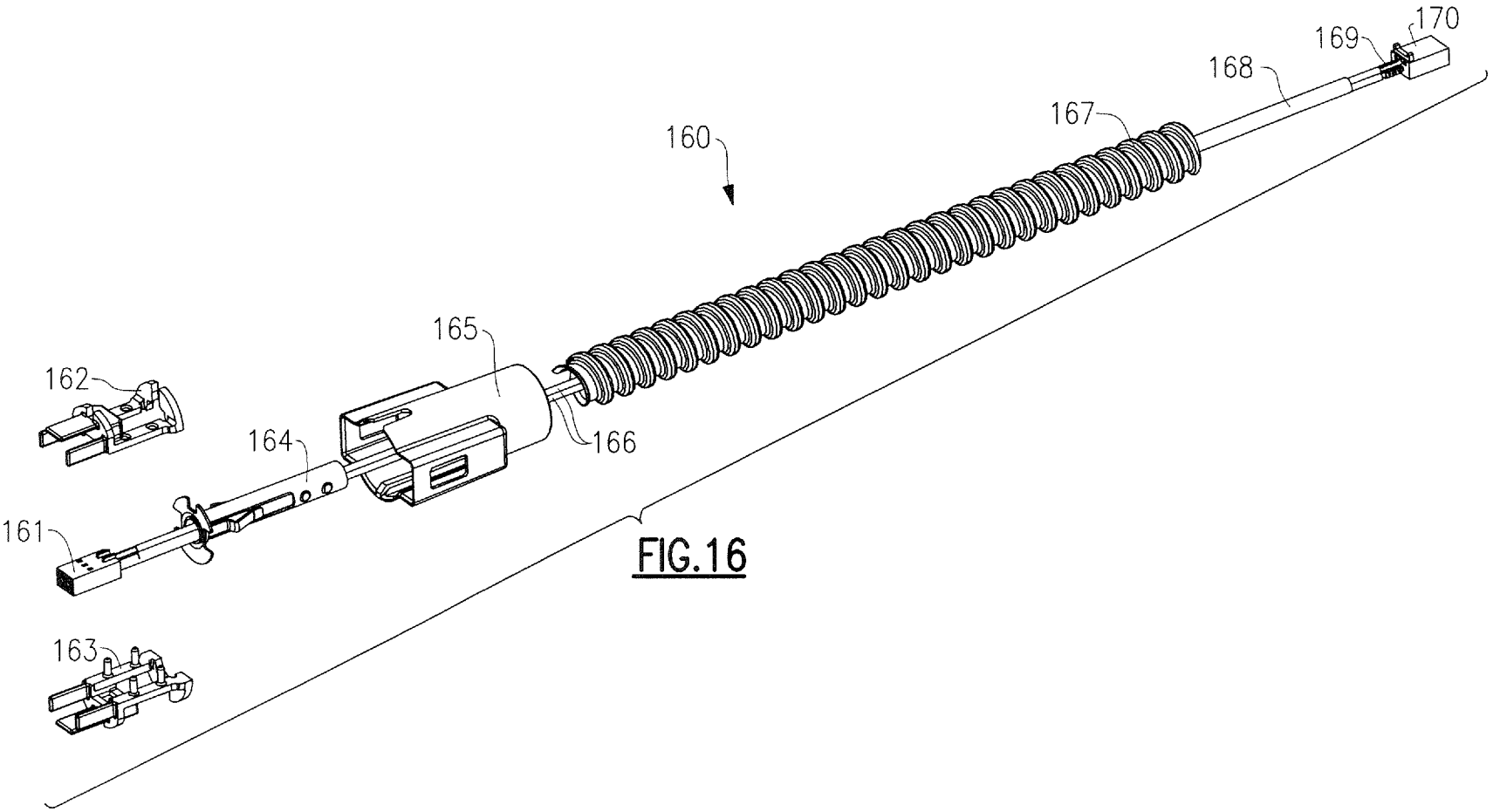
FIG. 16 is an exploded perspective view of a power input assembly 160 according to an embodiment in accordance with the present inventive subject matter.

FIG. 16 is an exploded perspective view of a power input assembly 160 that comprises a first electrical connector region 161 (in the form of a Molex® terminal), a first body element 162, a second body element 163, a retention element 164, a holding structure 165, electrical conductors 166, a conduit 167, jacketing 168 (insulating the electrical conductors 166), a second electrical connector region 169 (also in the form of a Molex® terminal), and a Molex® crimp terminal housing 170.

FIG. 17 schematically depicts a wiring arrangement for a lamp. In this arrangement, the following wiring diagram is employed:

| | | |
|---|---|---|
| 2 | BLUE | 1 S_DIM_IN |
| 5 | RED | 2 S_VSEC_POS |
| 6 | BLACK | 3 S_VSEC_NEG |

In some embodiments in accordance with the present inventive subject matter, there is provided a lighting device that has a plurality of heat dissipating fins that are spaced from one another in a general pattern (e.g., by relatively uniform distances and/or by a relatively uniform angular relationship relative to one or more axes), and in which that spacing is somewhat enlarged in one or more regions in order to provide space for a power input assembly to engage with one or more corresponding components on the lighting device. For example, in FIG. 1 and in FIG. 12, heat dissipation fins 19 are spaced by a relatively regular angular difference relative to the axis 16, except that a larger spacing in provided in the region where the keying region 11, the first electrical connector region 12, the first power input assembly engagement region 13 and the second power input assembly engagement region 14 are provided, in order to simplify connecting a power input assembly (e.g., a power input assembly 18) to those components.

In a representative sequence of assembling a power input assembly in accordance with the present inventive subject matter (e.g., a power input assembly corresponding to the power input assembly 30 depicted herein, electrical conductors (wires) are electrically connected to the second electrical connector region, the electrical conductors are then looped through the retention element, the first positioning element (e.g., first and second body elements) is then attached to the second electrical connector region (e.g., by assembling the second electrical connector region onto the second body element, then capturing the second electrical connector region by mating the first body element with the second body element such that the pins on the first body element extend through the respective pin receiving regions on the second body element (after which, if desired, one or more of the pins can be heat staked), then trapping the flange (of the retention element) by deflecting the flexible structures outward so that they can be placed on the opposite side of the flange relative to the second electrical connector region, then inserting the retention element into the holding structure while aligning the second indexing feature (on the holding structure) with the first indexing feature (on the first body element) the gap and the first notch (on the flange), until the flex element(s) of the retention element are received in the flex element-receiving regions (on the holding structure), and then the conduit is threaded on the conduit engaging structure(s) on the retention element.

FIGS. 18-25 are views of lamps that comprise lighting devices and power input assemblies that correspond to the present inventive subject matter.

As noted above, in accordance with a fifth aspect of the present inventive subject matter, there is provided a lighting device positioning apparatus, comprising:

a lighting device mounting region;

at least a first slide member and a second slide member; and at least a first connector, the first slide member comprising at least a first retaining structure-receiving feature, the first slide member comprising at least a first slot extending in a first direction, the second slide member comprising at least a second slot extending in a second direction, the first direction defining an angle of at least 20 degrees relative to the second direction, the first connector extending through the first slot and the second slot.

The lamps and lighting devices in accordance with the present inventive subject matter can be positioned using a lighting device positioning apparatus in accordance with the fifth aspect of the present inventive subject matter.

The lighting device positioning apparatus, and the components thereof, can comprise any suitable material or combination of materials, and can be in any suitable shape, so long as the apparatus and/or components are capable of performing the functions they are described herein as having.

A lighting device can be mounted in or on the lighting device mounting region.

The first retaining structure-receiving feature can retain and/or accommodate any one or more type(s) of suitable lighting device hanger system component (or components), a wide variety of which are well known to persons of skill in the art, e.g., flat bar systems, C-channel systems, pipe systems (e.g., ½ inch pipe systems), caddy bar systems (e.g., caddy bar 517A systems).

The first slide member can be moved relative to the second slide member when the connector is loosened, allowing the location of the lighting device to be adjusted relative to the lighting device hanger system component(s). For example, in some embodiments in accordance with this aspect of the present inventive subject matter, the connector can be selectively loosened and tightened, and the first clamp can be moved (if desired) in a first direction relative to the connector (by virtue of the connector extending through a first slot in the first clamp), and the second clamp can be moved (if desired) in a second direction relative to the connector (by virtue of the connector extending through a second slot in the second clamp).

A representative embodiment of a lighting device positioning apparatus 260 is depicted in FIG. 26. Referring to FIG. 26, the lighting device positioning apparatus comprises:

a lighting device mounting region 261 (in which a lighting device 262 is mounted);

a first slide member 263 and a second slide member 264;

a third slide member 265 and a fourth slide member 266;

a first connector (in the form of a bolt 267 and a wingnut 268), and a second connector (in the form of a bolt 269 and a wingnut (not visible in FIG. 26)).

Referring to FIG. 26, the first slide member 263 comprises a plurality of retaining structure-receiving features 270 for selective use with any of a wide variety of hanger systems (the third slide member 265 has similar retaining structure-receiving features.

Referring to FIG. 26, the first slide member 263 comprises a slot 271 extending in a horizontal direction (the third slide member 265 has a similar slot), and the fourth slide member 266 comprises a slot 272 extending in a vertical direction (the second slide member 264 has a similar slot).

As shown in FIG. 26, the bolt 269 of the first connector extends through the horizontal slot 271 in the first slide member 263 and through the vertical slot in the second slide member 264, and the bolt 269 of the second connector extends through the horizontal slot in the third slide member 265 and through the vertical slot 272 in the fourth slide member 266.

In positioning a lighting device using components as depicted in FIG. 26, one would select a desired hanger system (based, e.g., on preference or availability), slide respective components of the hanger system (e.g., two pipes 274, as shown in FIG. 26) through appropriate retaining structure-receiving features 270, and then securing the hanger system components to an existing structure (e.g., mounting structures 273 provided above a ceiling) in a conventional way, or in any of a variety of ways that persons of skill in the art can readily envision.

Then the wingnut 268 (and the other wingnut on the bolt 269) can be loosened (if they were not already loosened), and the lighting device can be brought to its desired location by moving it vertically (by virtue of the freedom of the respective bolts to move along the vertical slots, and the freedom of the first slide member to move relative to the second slide member and the third slide member to move relative to the fourth slide member) and/or horizontally (by virtue of the freedom of the respective bolts to move along the horizontal slots, and the freedom of the first slide member to move relative to the second slide member and the third slide member to move relative to the fourth slide member).

When the lighting device is in its desired location, the wingnut 268 (and the other wingnut on the bolt 269) can be tightened to prevent movement of the bolts relative to any of the slots.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Below are a series of numbered passages, each of which defines subject matter within the scope of the present inventive subject matter:

Passage 1. A lighting device, comprising:

a power input assembly engagement structure that comprises:

at least a first keying region;

at least a first electrical connector region; and at least a first power input assembly engagement region.

Passage 2. A lighting device as recited in passage 1 wherein the lighting device further comprises at least a first light emitter.

Passage 3. A lighting device as recited in passage 1 or passage 2, wherein the first power input assembly engagement region comprises at least a first spring element.

Passage 4. A lighting device as recited in any one of passages 1-3, wherein the first power input assembly engagement region comprises at least a first spring element-receiving region.

Passage 5. A lighting device as recited in passage 4, wherein the first spring element-receiving region comprises at least one recess.

Passage 6. A lighting device as recited in passage 4 or passage 5, wherein the first spring element-receiving region comprises at least one opening.

Passage 7. A lighting device as recited in any one of passages 1-6, wherein:

the lighting device further comprises at least a second power input assembly engagement region; and the first and second power input assembly engagement regions are on opposite sides relative to the first electrical connector region.

Passage 8. A lighting device as recited in any one of passages 1-7, wherein the first keying region comprises at least a first protrusion.

Passage 9. A lighting device as recited in passage 8, wherein the first protrusion extends in a direction substantially parallel to an axis of the lighting device.

Passage 10. A power input assembly, comprising:

at least a second electrical connector region;

at least a first positioning element; and at least a first holding structure, the first positioning element releasably engaged with the first holding structure, the second electrical connector region held by the first positioning element, whereby the second electrical connector region is held in place relative to the first holding structure.

Passage 11. A power input assembly as recited in passage 10, wherein the power input assembly further comprises at least a first electrical conductor.

Passage 12. A power input assembly as recited in passage 11, wherein:

the power input assembly further comprises at least a first conduit, and the electrical conductor extends through at least a portion of the first conduit.

Passage 13. A power input assembly as recited in any one of passages 10-12, wherein the power input assembly further comprises at least a first conduit.

Passage 14. A power input assembly as recited in any one of passages 10-13, wherein the second electrical connector region comprises at least a first alignment structure.

Passage 15. A power input assembly as recited in passage 14, wherein the first alignment structure comprises at least a first protrusion, a first recess or a first hole.

Passage 16. A power input assembly as recited in any one of passages 10-15, wherein the first positioning element comprises:

at least a first body structure; and at least a first alignment feature.

Passage 17. A power input assembly as recited in passage 16, wherein the second electrical connector region comprises at least a second alignment structure that engages with the first alignment feature.

Passage 18. A power input assembly as recited in any one of passages 10-17, wherein the first positioning element comprises at least a first body structure that comprises at least a first body element and a second body element.

Passage 19. A power input assembly as recited in passage 18, wherein:

the first body element comprises at least a first pin, the second body element comprises at least a first pin-receiving region, the first pin extends through a space defined by the first pin-receiving region, and at least a portion of the second electrical connector region is between (1) at least a portion of the first body element and (2) at least a portion of the second body element.

Passage 20. A power input assembly as recited in any one of passages 10-19, wherein:

the first positioning element comprises at least a first body structure and at least a first retention element, the first retention element comprises at least a first flange, the first body structure has at least one flange engagement structure, the first flange has at least one body structure engagement structure, and the flange engagement structure is engaged with the body structure engagement structure, whereby the first retention element is inhibited from rotating relative to the first body structure.

Passage 21. A power input assembly as recited in any one of passages 10-20, wherein the first positioning element comprises at least a first retention element that comprises at least a first flex element.

Passage 22. A power input assembly as recited in passage 21, wherein:

the first holding structure comprises at least a first flex element engagement structure, and the first flex element is releasably engaged with the first flex element engagement structure, whereby the first positioning element releasably engaged with the first holding structure.

Passage 23. A power input assembly as recited in passage 22, wherein the first flex element and the first flex element engagement structure are configured so that during assembly, the first positioning element is pushed in a first direction relative to the first holding structure, and said pushing the first positioning element in the first direction sequentially (1) causes the first flex element to come into contact with the first flex element engagement structure, which (2) causes the first flex element to flex in an inward direction, and then the first flex element clears the first flex element engagement structure, which (3) allows the first flex element to flex in an outward direction, thereby inhibiting motion of the first positioning element relative to the first holding structure in a second direction, the second direction opposite the first direction.

Passage 24. A power input assembly as recited in any one of passages 10-23, wherein:

the power input assembly further comprises at least a first conduit;

the first positioning element comprises at least a first retention element that comprises at least a first conduit engagement structure, and the first conduit and the first conduit engagement structure are configured such that during assembly, the first conduit is rotated relative to its axis and the first conduit engagement structure is threaded along an external surface of the first conduit.

Passage 25. A power input assembly as recited in any one of passages 10-24, wherein the first positioning element comprises at least a first retention element that comprises at least a first flange.

Passage 26. A power input assembly as recited in passage 25, wherein:

the first flange has at least a first indexing feature, the first holding structure has at least a second indexing feature, and the first indexing feature is engaged with the second indexing feature to inhibit rotation of the first retention element relative to the first holding structure.

Passage 27. A power input assembly as recited in passage 25 or passage 26, wherein:

the first body structure has at least a first indexing feature, the first holding structure has at least a second indexing feature, and the first indexing feature is engaged with the second indexing feature to inhibit rotation of the first body structure relative to the first holding structure.

Passage 28. A power input assembly as recited in passage 27, wherein:

the first body structure comprises at least a first flexible structure and a second flexible structure, and the first indexing feature is a gap is between a free end of the first flexible structure and a free end of the second flexible structure.

Passage 29. A power input assembly as recited in passage 28, wherein:

the first body structure further comprises at least a third indexing structure, the third indexing structure is engaged with the second indexing feature, and the third indexing structure is spaced from the gap by a distance that is at least 25 percent of a distance of the largest dimension of the first body structure.

Passage 30. A power input assembly as recited in any one of passages 10-29, wherein:

the first positioning element comprises at least a first body structure and a first retention element, the first body structure comprises at least a first flexible structure and a second flexible structure, the first retention element comprises at least a first flange, a first portion of the first body structure is on a first side of the first flange, and the first flexible structure and the second flexible structure are on a second side of the first flange.

Passage 31. A power input assembly as recited in passage 30, wherein the first positioning element comprises at least a first retention element that comprises at least a first flex element.

Passage 32. A power input assembly as recited in passage 30 or passage 31, wherein:

the first holding structure comprises at least a first flex element engagement structure, and the first flex element engagement structure is engaged with the first flex element.

Passage 33. A power input assembly as recited in any one of passages 10-32, wherein the first holding structure comprises at least a first lighting device engagement region.

Passage 34. A power input assembly as recited in passage 33, wherein the first lighting device engagement region comprises at least a first spring element.

Passage 35. A power input assembly as recited in passage 33 or passage 34, wherein the first power input assembly engagement region comprises at least a first spring element-receiving region.

Passage 36. A power input assembly as recited in passage 35, wherein the first spring element-receiving region comprises at least one recess.

Passage 37. A power input assembly as recited in passage 35 or passage 36, wherein the first spring element-receiving region comprises at least one opening.

Passage 38. A power input assembly as recited in any one of passages 10-37, wherein:

the first holding structure further comprises at least a second lighting device engagement region; and the first and second lighting device engagement regions are on opposite sides relative to the second electrical connector region.

Passage 39. A power input assembly as recited in any one of passages 10-38, wherein the first holding structure comprises at least a first keying structure.

Passage 40. A power input assembly as recited in passage 39, wherein the first keying structure comprises at least a first recess or opening.

Passage 41. A power input assembly as recited in passage 39 or passage 40, wherein the first keying structure comprises at least a first protrusion.

Passage 42. A lamp comprising:

at least a first lighting device; and at least a first power input assembly as recited in any one of passages 1-41, the first lighting device comprising:

an engagement structure that comprises:

at least a first keying region;

at least a first electrical connector region; and at least a first power input assembly engagement region.

Passage 43. A lamp as recited in passage 42, wherein the first lighting device further comprises at least a first light emitter.

Passage 44. A lamp as recited in passage 42 or passage 43, wherein the first power input assembly engagement region comprises at least a first spring element.

Passage 45. A lamp as recited in any one of passages 42-44, wherein the first power input assembly engagement region comprises at least a first spring element-receiving region.

Passage 46. A lamp as recited in passage 45, wherein the first spring element-receiving region comprises at least one recess.

Passage 47. A lamp as recited in passage 45 or passage 46, wherein the first spring element-receiving region comprises at least one opening.

Passage 48. A lamp as recited in any one of passages 42-47, wherein:

the lighting device further comprises at least a second power input assembly engagement region; and the first and second power input assembly engagement regions are on opposite sides relative to the first electrical connector region.

Passage 49. A lamp as recited in any one of passages 42-48, wherein the first keying region comprises at least a first protrusion.

Passage 50. A lamp as recited in passage 49, wherein the first protrusion extends in a direction substantially parallel to an axis of the lighting device.

Passage 51. A lamp as recited in any one of passages 42-50, wherein the power input assembly further comprises at least a first electrical conductor.

Passage 52. A lamp as recited in passage 51, wherein:

the power input assembly further comprises at least a first conduit, and the electrical conductor extends through at least a portion of the first conduit.

Passage 53. A lamp as recited in any one of passages 42-52, wherein the power input assembly further comprises at least a first conduit.

Passage 54. A lamp as recited in any one of passages 42-53, wherein the second electrical connector region comprises at least a first alignment structure.

Passage 55. A lamp as recited in passage 54, wherein the first alignment structure comprises at least a first protrusion, a first recess or a first hole.

Passage 56. A lamp as recited in any one of passages 42-55, wherein the first positioning element comprises:

at least a first body structure; and at least a first alignment feature.

Passage 57. A lamp as recited in passage 56, wherein the second electrical connector region comprises at least a second alignment structure that engages with the first alignment feature.

Passage 58. A lamp as recited in any one of passages 42-57, wherein the first positioning element comprises at least a first body structure that comprises at least a first body element and a second body element.

Passage 59. A lamp as recited in passage 58, wherein:

the first body element comprises at least a first pin, the second body element comprises at least a first pin-receiving region, the first pin extends through a space defined by the first pin-receiving region, and at least a portion of the second electrical connector region is between (1) at least a portion of the first body element and (2) at least a portion of the second body element.

Passage 60. A lamp as recited in any one of passages 42-59, wherein:

the first positioning element comprises at least a first body structure and at least a first retention element, the first retention element comprises at least a first flange, the first body structure has at least one flange engagement structure, the first flange has at least one body structure engagement structure, and the flange engagement structure is engaged with the body structure engagement structure, whereby the first retention element is inhibited from rotating relative to the first body structure.

Passage 61. A lamp as recited in any one of passages 42-60, wherein the first positioning element comprises at least a first retention element that comprises at least a first flex element.

Passage 62. A lamp as recited in passage 61, wherein:

the first holding structure comprises at least a first flex element engagement structure, and the first flex element is releasably engaged with the first flex element engagement structure, whereby the first positioning element releasably engaged with the first holding structure.

Passage 63. A lamp as recited in passage 62, wherein the first flex element and the first flex element engagement structure are configured so that during assembly, the first positioning element is pushed in a first direction relative to the first holding structure, and said pushing the first positioning element in the first direction sequentially (1) causes the first flex element to come into contact with the first flex element engagement structure, which (2) causes the first flex element to flex in an inward direction, and then the first flex element clears the first flex element engagement structure, which (3) allows the first flex element to flex in an outward direction, thereby inhibiting motion of the first positioning element relative to the first holding structure in a second direction, the second direction opposite the first direction.

Passage 64. A lamp as recited in any one of passages 42-63, wherein:

the power input assembly further comprises at least a first conduit;

the first positioning element comprises at least a first retention element that comprises at least a first conduit engagement structure, and the first conduit and the first conduit engagement structure are configured such that during assembly, the first conduit is rotated relative to its axis and the first conduit engagement structure is threaded along an external surface of the first conduit.

Passage 65. A lamp as recited in any one of passages 42-64, wherein the first positioning element comprises at least a first retention element that comprises at least a first flange.

Passage 66. A lamp as recited in passage 65, wherein:

the first flange has at least a first indexing feature, the first holding structure has at least a second indexing feature, and the first indexing feature is engaged with the second indexing feature to inhibit rotation of the first retention element relative to the first holding structure.

Passage 67. A lamp as recited in passage 65 or passage 66, wherein:

the first body structure has at least a first indexing feature, the first holding structure has at least a second indexing feature, and the first indexing feature is engaged with the second indexing feature to inhibit rotation of the first body structure relative to the first holding structure.

Passage 68. A lamp as recited in passage 67, wherein:

the first body structure comprises at least a first flexible structure and a second flexible structure, and the first indexing feature is a gap is between a free end of the first flexible structure and a free end of the second flexible structure.

Passage 69. A lamp as recited in passage 67 or passage 68, wherein:

the first body structure further comprises at least a third indexing structure, the third indexing structure is engaged with the second indexing feature, and the third indexing structure is spaced from the gap by a distance that is at least 25 percent of a distance of the largest dimension of the first body structure.

Passage 70. A lamp as recited in any one of passages 42-69, wherein:

the first positioning element comprises at least a first body structure and a first retention element, the first body structure comprises at least a first flexible structure and a second flexible structure, the first retention element comprises at least a first flange, a first portion of the first body structure is on a first side of the first flange, and the first flexible structure and the second flexible structure are on a second side of the first flange.

Passage 71. A lamp as recited in passage 70, wherein the first positioning element comprises at least a first retention element that comprises at least a first flex element.

Passage 72. A lamp as recited in passage 70 or passage 71, wherein:

the first holding structure comprises at least a first flex element engagement structure, and the first flex element engagement structure is engaged with the first flex element.

Passage 73. A lamp as recited in any one of passages 42-72, wherein the first holding structure comprises at least a first lighting device engagement region.

Passage 74. A lamp as recited in passage 73, wherein the first lighting device engagement region comprises at least a first spring element.

Passage 75. A lamp as recited in passage 73 or passage 74, wherein the first power input assembly engagement region comprises at least a first spring element-receiving region.

Passage 76. A lamp as recited in passage 75, wherein the first spring element-receiving region comprises at least one recess.

Passage 77. A lamp as recited in passage 75 or passage 76, wherein the first spring element-receiving region comprises at least one opening.

Passage 78. A lamp as recited in any one of passages 75-77, wherein:

the first holding structure further comprises at least a second lighting device engagement region; and the first and second lighting device engagement regions are on opposite sides relative to the second electrical connector region.

Passage 79. A lamp as recited in any one of passages 42-78, wherein the first holding structure comprises at least a first keying structure.

Passage 80. A lamp as recited in passage 79, wherein the first keying structure comprises at least a first recess or opening.

Passage 81. A lamp as recited in passage 79 or passage 80, wherein the first keying structure comprises at least a first protrusion.

Passage 82. A method of connecting a power input assembly to a lighting device, the method comprising:

engaging a second electrical connector region of a power input assembly with a first electrical connector region of a lighting device, the lighting device comprising:

at least a first light emitter; and at least a first power input assembly engagement structure that comprises:

the first electrical connector region; and at least a first power input assembly engagement region, the power input assembly comprising:

the second electrical connector region;

at least a first positioning element; and at least a first holding structure, the first positioning element releasably engaged with the first holding structure, the first electrical connector region held by the first positioning element, whereby the first electrical connector region is held in place relative to the first holding structure.

Passage 83. A method as recited in passage 82, wherein said engaging a second electrical connector region of a power input assembly with a first electrical connector region of a lighting device is carried out in a single step by moving the power input assembly relative to the lighting device.

Passage 84. A method as recited in passage 82 or passage 83, wherein said engaging a second electrical connector region of a power input assembly with a first electrical connector region of a lighting device is carried out by moving the power input assembly in a single direction relative to the lighting device.

Passage 85. A method as recited in passage 84, wherein:

the first electrical connector region comprises at least a first conductive pin, and during said engaging a second electrical connector region of a power input assembly with a first electrical connector region of a lighting device, an axis of the first conductive pin extends in a direction substantially parallel to or substantially co-linear with the single direction.

Passage 86. A method as recited in passage 85, wherein:

the second electrical connector region comprises at least a first recess or opening, and during said engaging a second electrical connector region of a power input assembly with a first electrical connector region of a lighting device, an axis of the first recess or opening extends in a direction substantially parallel to or substantially co-linear with the single direction.

Passage 87. A method as recited in any one of passages 84-86, wherein:

the first electrical connector region comprises at least a first recess or opening, and during said engaging a second electrical connector region of a power input assembly with a first electrical connector region of a lighting device, an axis of the first recess or opening extends in a direction substantially parallel to or substantially co-linear with the single direction.

Passage 88. A method as recited in passage 87, wherein:

the second electrical connector region comprises at least a first conductive pin, and during said engaging a second electrical connector region of a power input assembly with a first electrical connector region of a lighting device, an axis of the first conductive pin extends in a direction substantially parallel to or substantially co-linear with the single direction.

Passage 89. A method as recited in any one of passages 82-88, wherein:

the first holding structure comprises at least a first lighting device engagement region, and during said engaging a second electrical connector region of a power input assembly with a first electrical connector region of a lighting device, the first lighting device engagement region engages the first power input assembly engagement region.

Passage 90. A method as recited in any one of passages 82-89, wherein:

the first holding structure comprises at least a first keying structure;

the power input assembly engagement structure comprises at least a first keying region; and during said engaging a second electrical connector region of a power input assembly with a first electrical connector region of a lighting device, the first keying structure engages the first keying region.

Passage 91. A lighting device positioning apparatus, comprising:

a lighting device mounting region;

at least a first slide member and a second slide member; and at least a first connector, the first slide member comprising at least a first retaining structure-receiving feature, the first slide member comprising at least a first slot extending in a first direction, the second slide member comprising at least a second slot extending in a second direction, the first direction defining an angle of at least 20 degrees relative to the second direction, the first connector extending through the first slot and the second slot.

Passage 92. A hanger system as recited in passage 91, wherein the first direction is substantially perpendicular to the second direction.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lamps, lighting devices, power input assemblies and lighting device positioning apparatuses described herein can be integrated. Any structural part of the lamps, lighting devices and power input assemblies described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A lighting device, comprising:

at least first and second heat dissipation structures; and a power input assembly engagement structure that comprises:

at least a first keying region;

at least a first electrical connector region; and at least a first power input assembly engagement region, the first keying region, the first electrical connector region and the first power input assembly engagement region between the first heat dissipation structure and the second heat dissipation structure.

2. A lighting device as recited in claim 1, wherein the first power input assembly engagement region comprises at least a first spring element.

3. A lighting device as recited in claim 1, wherein the first power input assembly engagement region comprises at least a first spring element-receiving region.

4. A lighting device as recited in claim 1, wherein:
the lighting device further comprises at least a second power input assembly engagement region; and
the first and second power input assembly engagement regions are on opposite sides relative to the first electrical connector region.

5. A power input assembly, comprising:
at least a second electrical connector region;
at least a first body structure which comprises at least a first body element and at least a first indexing feature; and
at least a first holding structure which comprises at least a second indexing feature,
the first indexing feature comprising a notch,
the second indexing feature comprising a ridge and extending longitudinally along at least a portion of the first holding structure,
the first indexing feature and the second indexing feature engaged, thereby inhibiting rotation of the first body structure relative to the first holding structure,
the second electrical connector region held by the at least a first body structure, whereby the second electrical connector region is held in place relative to the first holding structure.

6. A power input assembly as recited in claim 5, wherein the power input assembly further comprises at least a first electrical conductor.

7. A power input assembly as recited in claim 5, wherein the second electrical connector region comprises at least a first alignment structure.

8. A power input assembly as recited in claim 7, wherein the first alignment structure is configured to align the second electrical connector region relative to a first electrical connector region of a power input assembly engagement structure.

9. A power input assembly as recited in claim 5, wherein the first body element comprises:
at least a first alignment feature.

10. A power input assembly as recited in claim 5, wherein:
the first body structure comprises at least a first body element and a second body element,
the first body element comprises at least a first pin,
the second body element comprises at least a first pin-receiving region,
the first pin extends through a space defined by the first pin-receiving region, and
at least a portion of the second electrical connector region is between (1) at least a portion of the first body element and (2) at least a portion of the second body element.

11. A power input assembly as recited in claim 5, wherein the first holding structure comprises at least a first keying structure.

12. A lamp comprising:
at least a first lighting device; and
at least a first power input assembly, the power input assembly, comprising:
at least a second electrical connector region;
at least a first positioning element; and
at least a first holding structure,
the first holding structure comprising at least one lighting device engagement region, the lighting device engagement region comprising at least a first opening,
the first positioning element releasably engaged with the first holding structure,
the second electrical connector region held by the first positioning element, whereby the second electrical connector region is held in place relative to the first holding structure,
the first lighting device comprising:
a power input assembly engagement structure that comprises:
at least a first keying region;
at least a first electrical connector region; and
at least a first power input assembly engagement region,
a portion of the first power input assembly engagement region extending through the first opening.

13. A lamp as recited in claim 12, wherein the first power input assembly engagement region comprises at least a first spring element.

14. A lamp as recited in claim 12, wherein the first power input assembly engagement region comprises at least a first spring element-receiving region.

15. A lamp as recited in claim 12, wherein:
the lighting device further comprises at least a second power input assembly engagement region; and
the first and second power input assembly engagement regions are on opposite sides relative to the first electrical connector region.

16. A lamp as recited in claim 12, wherein the power input assembly further comprises at least a first electrical conductor.

17. A lamp as recited in claim 12, wherein:
the first positioning element comprises at least a first body structure that comprises at least a first body element and a second body element,
the first body element comprises at least a first pin,
the second body element comprises at least a first pin-receiving region,
the first pin extends through a space defined by the first pin-receiving region, and
at least a portion of the second electrical connector region is between (1) at least a portion of the first body element and (2) at least a portion of the second body element.

18. A lamp as recited in claim 12, wherein:
the first positioning element comprises at least a first body structure and at least a first retention element,
the first retention element comprises at least a first flange,
the first body structure has at least one flange engagement structure,
the first flange has at least one body structure engagement structure, and
the flange engagement structure is engaged with the body structure engagement structure, whereby the first retention element is inhibited from rotating relative to the first body structure.

19. A lamp as recited in claim 12, wherein neither the first electrical connector region nor the second electrical connector region extends through the lighting device engagement region.

20. A method of connecting a power input assembly to a lighting device, the method comprising:
engaging a second electrical connector region of a power input assembly with a first electrical connector region of a lighting device,
the lighting device comprising:
at least a first light emitter; and
at least a first power input assembly engagement structure that comprises:
the first electrical connector region; and
at least a first power input assembly engagement region,
the power input assembly comprising:
the second electrical connector region;

at least a first body structure which comprises at least a first body element and at least a first indexing feature; and at least a first holding structure which comprises at least a second indexing feature and at least one lighting device engagement region, the first indexing feature and the second indexing feature engaged, thereby inhibiting rotation of the first body structure relative to the first holding structure, the lighting device engagement region comprising at least a first opening, the first positioning element releasably engaged with the first holding structure, the second electrical connector region held by the first body structure, whereby the second electrical connector region is held in place relative to the first holding structure; and extending a portion of the first power input assembly engagement region through the first opening when engaging the second electrical connector region of the power input assembly with the first electrical connector region of the lighting device.

21. A method as recited in claim 20, wherein during said extending a portion of the first power input assembly engagement region through the first opening, neither the first electrical connector region nor the second electrical connector region passes through the first opening.

22. A power input assembly comprising:

at least a second electrical connector region;

at least a first positioning element; and at least a first holding structure, the first positioning element releasably engaged with the first holding structure, the second electrical connector region held by the first positioning element, whereby the second electrical connector region is held in place relative to the first holding structure, the first positioning element comprising at least a first body structure that comprises at least a first body element and a second body element, the first body element comprising at least a first pin, second body element comprising at least a first pin-receiving region, the first pin-receiving region a hole with a first pin-receiving axis in the second body element, the first pin having a first pin axis and extending through a space defined by the first pin-receiving region, the first pin-receiving axis aligned with the first pin axis, and at least a portion of the second electrical connector region between (1) at least a portion of the first body element and (2) at least a portion of the second body element.

23. A power input assembly as recited in claim 22, wherein an entirety of the first body element, except for the at least a first pin, is on a first side of a first plane, and an entirety of the second body element is on a second side of the first plane.

24. A power input assembly, comprising:

at least a second electrical connector region;

at least a first positioning element; and at least a first holding structure, the first positioning element releasably engaged with the first holding structure, the second electrical connector region held by the first positioning element, whereby the second electrical connector region is held in place relative to the first holding structure, the first positioning element comprising at least a first holding portion, a second holding portion, and a third holding portion, each of the first holding portion, the second holding portion, and the third holding portion separately extending from the first positioning element adjacent to the second electrical connector region, the first holding portion covering at least part of a first side of the second electrical connector region, the second holding portion covering at least part of a second side of the second electrical connector region, the third holding portion covering at least part of a third side of the second electrical connector region, each of the first, second and third sides of the second electrical connector region different from each other.

25. A power input assembly as recited in claim 24, wherein the first holding portion, the second holding portion, and the third holding portion each extend from a first plane to a second plane, and each of the first holding portion, the second portion, and the third holding portion is entirely between the first plane and the second plane.

26. A power input assembly as recited in claim 25, wherein the first plane and the second plane are each perpendicular to an axis of the power input assembly.

27. A power input assembly comprising:

at least a second electrical connector region;

at least a first body structure which comprises at least a first body element, at least a first indexing feature, and at least a first retention element; and at least a first holding structure which comprises at least a second indexing feature, the first indexing feature and the second indexing feature engaged, thereby inhibiting rotation of the first body structure relative to the first holding structure, the second electrical connector region held by the at least a first body structure, whereby the second electrical connector region is held in place relative to the first holding structure, the first retention element comprising at least a first flange, the first flange comprising least a first notch, the first notch and the second indexing feature engaged.

28. A power input assembly comprising:

at least a second electrical connector region;

at least a first body structure which comprises at least a first body element and at least a first indexing feature; and at least a first holding structure which comprises at least a second indexing feature, the first indexing feature and the second indexing feature engaged, thereby inhibiting rotation of the first body structure relative to the first holding structure, the second electrical connector region held by the at least a first body structure, whereby the second electrical connector region is held in place relative to the first holding structure, the first body element having a first flexible structure, a second flexible structure, and a gap between the first flexible structure and the second flexible structure the second indexing feature engaging the first gap.

29. A power input assembly comprising:

at least a second electrical connector region;

at least a first body structure which comprises at least a first body element, at least a first indexing feature, and at least a first retention element; and at least a first holding structure which comprises at least a second indexing feature, the first indexing feature and the second indexing feature engaged, thereby inhibiting rotation of the first body structure relative to the first holding structure, the second electrical connector region held by the at least a first body structure, whereby the second electrical connector region is held in place relative to the first holding structure, the first retention element comprising at least a first flex element, the first holding structure comprising at least a first flex element-receiving region, the first flex element received in the first flex element-receiving region.

30. A lamp comprising:

at least a first lighting device; and at least a first power input assembly, the power input assembly, comprising:

at least a second electrical connector region;

at least a first positioning element; and at least a first holding structure, the first holding structure comprising a keying structure that comprises a recess, the first positioning element releasably engaged with the first holding structure, the second electrical connector region held by the first positioning element, whereby the second electrical connector region is held in place relative to the first holding structure, the first lighting device comprising:

a power input assembly engagement structure that comprises:

at least a first keying region;

at least a first electrical connector region; and at least a first power input assembly engagement region, the keying region comprising a protrusion extending substantially parallel to an axis of the lamp, the keying structure configured to engage with the keying region.

* * * * *

UNITED STATES PATENT AND TRADEMARK OFFICE

CERTIFICATE OF CORRECTION

PATENT NO. : 8,998,633 B2
APPLICATION NO. : 13/461248
DATED : April 7, 2015
INVENTOR(S) : Peter E. Lopez It is certified that error appears in the above-identified patent and that said Letters Patent is hereby corrected as shown below:

In the Claims

Claim 22, Col. 33, Lines 42-43

Please change: "second body element comprising at least a first pin-receiving region,"

to -- the second body element comprising at least a first pin-receiving region, --

Claim 27, Col. 34, Line 39

Please change: "the first flange comprising least a first notch," to -- the first flange comprising at least a first notch, --

Signed and Sealed this
Twenty-ninth Day of September, 2015

Michelle K. Lee

Michelle K. Lee
*Director of the United States Patent and Trademark Office*